United States Patent [19]

Hamajima et al.

[11] Patent Number: 4,744,945

[45] Date of Patent: May 17, 1988

[54] PROCESS FOR MANUFACTURING ALLOY INCLUDING FINE OXIDE PARTICLES

[75] Inventors: Kaneo Hamajima; Tadashi Dohnomoto; Atsuo Tanaka; Masahiro Kubo, all of Toyota, Japan

[73] Assignee: Toyota Jidosha Kabushiki Kaisha, Toyota, Japan

[21] Appl. No.: 888,650

[22] Filed: Jul. 28, 1986

Related U.S. Application Data

[63] Continuation of Ser. No. 723,918, Apr. 16, 1985, abandoned.

[30] Foreign Application Priority Data

Dec. 4, 1984 [JP] Japan ..... 59-256336

[51] Int. Cl.[4] ..... C22C 1/00

[52] U.S. Cl. ..... 420/129; 420/590

[58] Field of Search ..... 428/614; 420/590, 129; 75/951, 129, 133, 133.5

[56] References Cited

U.S. PATENT DOCUMENTS

| | | | |
|---|---|---|---|
| 3,026,200 | 3/1962 | Gregory | 75/951 |
| 3,031,340 | 4/1962 | Giradot | 117/118 |
| 3,184,306 | 5/1965 | Fish | 75/206 |
| 3,396,777 | 8/1968 | Reding, Jr. | 164/9 |
| 3,399,086 | 8/1968 | Das et al. | 148/432 |
| 3,779,714 | 12/1973 | Nadkani et al. | 29/182.5 |
| 4,457,979 | 7/1984 | Donomoto et al. | 428/614 |

FOREIGN PATENT DOCUMENTS

| | | | |
|---|---|---|---|
| 26204 | 4/1973 | Japan . | |
| 152141 | 11/1980 | Japan | 420/590 |
| 194228 | 5/1981 | Japan . | |
| 1117669 | 6/1968 | United Kingdom . | |

*Primary Examiner*—Christopher W. Brody
*Attorney, Agent, or Firm*—Oblon, Fisher, Spivak, McClelland & Maier

[57] ABSTRACT

In this method for making an alloy of a first metal and a second metal which has a stronger tendency to form an oxide than the first metal, a powdered solid is prepared comprising at least one of a compound of the first metal with oxygen and the second metal, the compound is mixed with the second metal, and an alloying process is carried out of alloying a melt with the powdered solid, in which the second metal is oxidized by the oxygen of the compound of the first metal with oxygen which is reduced. The compound of the first metal with oxygen may be an oxide, and may be a simple oxide or a compound oxide. As one variation, the powdered solid may contain the compound of the first metal with oxygen, in which case the melt will contain the second metal; or alternatively the powdered solid may contain the second metal, in which case the melt will contain the compound of the first metal with oxygen. Alternatively, the powdered solid may contain both the compound of the first metal with oxygen and the second metal, in which case the melt may contain a third metal.

21 Claims, 8 Drawing Sheets x 100 x 1000 x 1000 x 1000 x 1000 x 400 x 400 x 400 x 400 x 400 x 400 x 100 x 100 x 400 x 400 x 400 x 400

PROCESS FOR MANUFACTURING ALLOY INCLUDING FINE OXIDE PARTICLES

This application is a continuation of application Ser. No. 723,918, filed 4/16/85, now abandoned.

BACKGROUND OF THE INVENTION

The present invention relates to alloys including fine metal oxide particles, and in particular to a method of manufacturing such alloys by utilization of an oxidization reduction reaction.

In the prior art, alloys in which a metal oxide is finely dispersed in a base metal have conventionally been made by, for example, (1) the so called powder metallurgy method, in which a powder of the metal oxide and a powder of the base metal are mixed together and then the mixture of these powders is heated to a high temperature and is sintered; (2) the method in which a powder of the metal oxide is formed into a porous solid and then the molten base metal is caused to permeate this porous solid, possibly under pressure; and (3) the so called internal oxidization method, in which a metal solid is formed of the base metal and of the metal of which it is desired to utilize the oxide, and then oxygen is supplied from the surface of the metal solid to the interior of the solid, so that the metal of which it is desired to utilize the oxide is oxidized (this metal should have a higher tendency to become oxidized than the base metal).

The methods (1) and (2) above allow an alloy in which the metal oxide is finely dispersed to be made relatively cheaply and efficiently, but the following problems arise. First, the combination of base metal and metal oxide is restricted to a combination in which there is mutual chemical stability, so that the manufacture of an alloy of arbitrary chemical composition is difficult. Also, there is a tendency for the surface tension between the base metal and the metal oxide to be insufficient, and this gives rise to problems with the strength of the resulting alloy. Further, a tendency arises, when a part made of the alloy is in sliding frictional contact with another element such as a mating member, that particles of the metal oxide should become detached from said part made of the alloy, thus causing undue wear and also causing damage, such as scuffing, to the mating member. In particular, in the case of the sintering method (1), since it is difficult to avoid completely that some of the air or atmospheric gas present among the powders from beforehand should remain after the sintering process, the manufacture of an alloy with a full 100% density is difficult, and further the problems exist of heating to a high temperature in the sintering stage and of control of the atmosphere. Further, in the case of method (3) above, i.e. the so called internal oxidation method, a alloy in which the surface tension between the base metal and the metal oxide particles included therein can be manufactured which has excellent characteristics, but there arise the problems that since the solid metal must be heated to a high temperature near to its melting point for a long time the manufacturing cost is high, and further that when the volume of the alloy to be manufactured is required to be great it is difficult to ensure that the metal oxide is dispersed satisfactorily within the resulting compound material as far as its center; in other words, it is difficult to control the size and dispersion pattern of the included particle mass metal oxide.

In Japanese Patent Application Ser. No. 58-13810 (1983), the applicant of which was the same as the applicant of the Japanese application of which priority is being claimed in the present patent application and as the assignee of the present patent application, and which it is not hereby intended to admit as prior art except to the extent otherwise obliged by law, there has been proposed a method of manufacture of an alloy of a first metal and a second metal whose melting point is lower than the melting point of said first metal, characterized in that: a porous body is formed from the first metal; the porous body is disposed within a mold; the second metal in molten form is poured into the mold; the first metal and the second metal are alloyed together by causing the molten metal to permeate the porous body (as by the application of pressure); and thus an alloy is formed such that in the region where the porous body originally was the second metal does not substantially exist by itself any more. According to this method, it is certainly possible to manufacture an alloy of a type which cannot be made by conventional methods; but this method is not suitable for manufacturing an alloy in which particles of a metal oxide are finely dispersed.

SUMMARY OF THE INVENTION

Accordingly, it is the primary object of the present invention to provide a method of manufacture of an alloy including fine particles of metal oxide, which avoids the above detailed problems.

It is a further object of the present invention to provide such a method of manufacture of an alloy including fine particles of metal oxide, which allows the selection of an arbitrary combination of base metal and metal oxide.

It is a further object of the present invention to provide such a method of manufacture of an alloy including fine particles of metal oxide, which can be performed at low cost.

It is a further object of the present invention to provide such a method of manufacture of an alloy including fine particles of metal oxide, which can be performed at high efficiency.

It is a further object of the present invention to provide such a method of manufacture of an alloy including fine particles of metal oxide, which ensures that the surface tension between the base metal and the metal oxide particles is sufficient.

It is a yet further object of the present invention to provide such a method of manufacture of an alloy including fine particles of metal oxide, which ensures that the stregth of the resulting compound alloy material is high.

It is a yet further object of the present invention to provide such a method of manufacture of an alloy including fine particles of metal oxide, which ensures the manufacture of an alloy with a full 100% density.

It is a yet further object of the present invention to provide such a method of manufacture of an alloy including fine particles of metal oxide, which ensure that no problems arise with regard to control of the size and the dispersion pattern of the included mass of metal oxide particles.

It is a further object of the present invention to provide such a method of manufacture of an alloy including fine particles of metal oxide, in which the resultant material has good wear characteristics with regard to wear on itself during use.

It is a yet further object of the present invention to provide such a method of manufacture of an alloy including fine particles of metal oxide, in which the resultant material does not cause undue wear on, or scuffing of, a mating member against which a member made of it is frictionally rubbed during use.

According to the most general aspect of the present invention, these and other objects are accomplished by a method for making an alloy of a first metal and a second metal which has a stronger tendency to form an oxide than said first metal, wherein: a powdered solid is prepared comprising at least one of a compound of said first metal with oxygen and said second metal; said compound is mixed with said second metal; and an alloying process is carried out of alloying a melt with said powdered solid, in which said second metal is oxidized by the oxygen of said compound of said first metal with oxygen which is reduced.

According to such a method, at least one of a compound of the first metal with oxygen and a second metal which has a higher tendency to form oxide than said first metal is prepared as a powdered solid mass; and the compound is mixed with the second metal (either in the previously mentioned stage or in the next stage); and then in the alloying process wherein the melt is alloyed with the powdered solid the second metal abstracts oxygen from the compound of the first metal with oxygen, thus reducing it, and is itself oxidized, thus producing a quantity of the oxide of the second metal; and at the same time the first and second metals and the resultant oxide of the second metal are heated up by the net heat which is produced by this reaction of oxidization and reduction. By this method, the oxide of the second metal is produced in a very finely divided state, and is finely dispersed in the base first metal, and thus the surface tension between the base metal and the metal oxide particles is high. Further, this method allows the selection of an arbitrary combination of base metal and metal oxide, and can be performed at low cost and at high efficiency. It is ensured that the strength of the resulting compound alloy material is high, and that the alloy material has a full 100% density; and further it is ensured that no problems arise with regard to control of the size and the dispersion pattern of the included mass of metal oxide particles. The resultant material has good wear characteristics with regard to wear on itself during use, and further, due to the good fixing of the metal oxide particles therein, is not subject to these particles becoming dislodged, and thus does not cause undue wear on, or scuffing of, a mating member against which a member made of said resultant material is frictionally rubbed during use.

The compound of the first metal with oxygen may be any compound, as long as it is capable of being reduced to supply the second metal with some oxygen; however, according to a more particular aspect of the present invention, these and other objects are more particularly and concretely accomplished by such a method as detailed above, wherein said compound of said first metal with oxygen is a simple oxide; or alternatively wherein said compound of said first metal with oxygen is a compound oxide (which may be a double salt).

Further, according to another more particular aspect of the present invention, these and other objects are yet more particularly and concretely accomplished by such a method as first detailed above, wherein said powdered solid comprises said compound of said first metal with oxygen, and said melt contains said second metal.

In this case, the oxidization reduction reaction is brought about by the heat in the molten second metal. Thus, in this case, it is not necessary to heat for a long time to a high temperature the mixture of the compound of the first metal with oxygen and the second metal, and as compared to the conventional internal oxidization method an alloy can be manufactured according to the present invention with very much higher efficiency and accordingly lower cost.

Further, according to another more particular aspect of the present invention, these and other objects are yet more particularly and concretely accomplished by such a method as first detailed above, wherein said powdered solid comprises said second metal, and said melt comprises said compound of said first metal with oxygen.

In this case, the oxidization reduction reaction is brought about by the heat in the molten compound of said first metal with oxygen. Thus, in this case also, it is not necessary to heat for a long time to a high temperature the mixture of the compound of the first metal with oxygen and the second metal, and as compared to the conventional internal oxidization method an alloy can be manufactured according to the present invention with very much higher efficiency and accordingly lower cost.

Further, according to yet another more particular aspect of the present invention, these and other objects are yet more particularly and concretely accomplished by such a method as first detailed above, wherein said powdered solid comprises both said compound of said first metal with oxygen and said second metal.

In this case, the oxidization reduction reaction is brought about by the heat in the melt, which in fact contains neither said compound of said first metal with oxygen nor said second metal, and typically contains a third metal in molten form. However, in this case also, it is not necessary to heat for a long time to a high temperature the mixture of the compound of the first metal with oxygen and the second metal, and as compared to the conventional internal oxidization method an alloy can be manufactured according to the present invention with very much higher efficiency and accordingly lower cost. Further, since the powdered solid material comprises both said compound of said first metal with oxygen and said second metal, by evenly mixing these two elements in said powdered solid material, it is possible to properly ensure even distribution of the resultant particles of the oxide of the first metal in the compound material which is produced. Further, by changing the size or the shape of the powdered solids and the distribution or the concentration of the powder of the compound of the first metal with oxygen and of the powder of the second metal, and so forth, it is possible to control fairly arbitrarily the distribution and concentration of the resultant particles of the oxide of the first metal in the compound material which is produced. And in particular, even when the mass of the alloy material which is to be produced is relatively large, it is possible to manufacture an alloy material in which the metal oxide particles are satisfactorily dispersed towards the interior.

Further, according to yet another more particular aspect of the present invention, these and other objects are yet more particularly and concretely accomplished by such a method as first detailed above, when a porous solid is formed from said compound of said first metal with oxygen and/or said second metal, before the molten melt is caused to permeate said porous solid, said porous solid may be preheated up to a temperature of not less than room temperature and preferably far above room temperature, such as for example a temperature at least as high as the melting temperature of the material consulting the melt. In this way, when the molten melt is caused to permeate the porous solid, quick cooling of the melt by the porous solid is avoided, and thereby the wetting of the porous solid by the molten melt is improved. Thus, it is possible to cause the molten melt to traverse rapidly and effectively the interstices of the porous solid, and thereby an alloy of which the density is 100% can be effectively and efficiently manufactured.

Further, according to yet another more particular aspect of the present invention, these and other objects are yet more particularly and concretely accomplished by such a method as first detailed above, when a porous solid is formed from said compound of said first metal with oxygen and/or said second metal, by pressurizing the molten melt so as to cause it to permeate said porous solid more effectively and rapidly and satisfactorily. Thereby, the manufacturing efficiency of the resulting alloy material is improved.

In the above case, the application of pressure to the molten melt may preferably be performed by the use of a pressurized casting method, such as the so called high pressure casting method, the die-cast casting method, or the centrifugal casting method; alternatively, the reduced pressure casting method or the low pressure casting method may be used.

In the method of the present invention, the powdered material may, in more close detail, in fact be a powder, a discontinuous fiber material, chips, or flakes and the like; and the term "powdered" is to be understood herein in this broad sense; but the use of an actual fine powder is considered to be preferable. In fact, it is considered to be preferable for the average diameter of the particles of the powdered material to be not more than 100 microns, and even more preferably to be not more than 50 microns.

BRIEF DESCRIPTION OF THE DRAWINGS

The present invention will now be described in terms of several preferred embodiments thereof, and with reference to the appended drawings. However, it should be understood that the description of the embodiments, and the drawings, are not any of them intended to be limitative of the scope of the present invention, since this scope is intended to be understood as to be defined by the appended claims, in their legitimate and proper interpretation. In the drawings, like reference symbols denote like parts and dimensions and so on in the separate figures thereof; spatial terms are to be understood as referring only tho the orientation on the drawing paper of the relevant figure and not to any actual orientation of an embodiment, unless otherwise qualified; in the description, all percentages are to be understood as being by weight unless otherwise indicated; and:

DESCRIPTION OF THE PREFERRED EMBODIMENTS

The present invention will now be described with reference to the preferred embodiments thereof, and with reference to the appended drawings.

THE FIRST PREFERRED EMBODIMENT

MOLTEN ALUMINUM METAL COMPOUNDED INTO $MoO_3$

Figure 1:
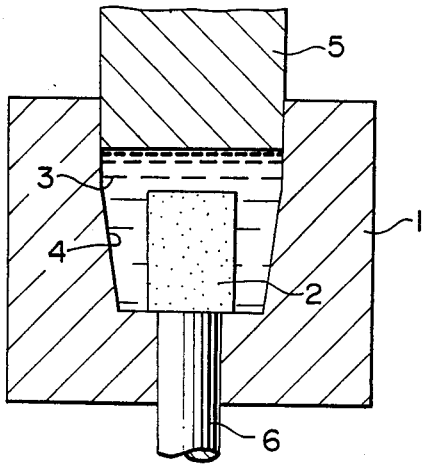
FIG. 1 is a schematic sectional diagram showing a high pressure casting device including a mold with a mold cavity and a pressure piston which is being forced into said mold cavity in order to pressurize molten metal around a preform which is being received in said mold cavity, during a casting stage of manufacture of a material according to the first preferred embodiment of the method of the present invention.

FIG. 1 is a schematic vertical sectional view taken through a high pressure casting device used in the first preferred embodiment. In this figure, the reference numeral 1 denotes a mold, which is formed with a mold cavity 4. A pressure piston 5 cooperates with this mold cavity 4 and is pressed downwards in the figure by a means, not shown, so as to apply pressure to a quantity 3 of molten metal which is being received in said mold cavity 4 as surrounding a preform 2 made of porous material previously placed in said mold cavity 4. When the quantity 3 of molten metal has solidified, the resulting cast piece is removed from the mold cavity 4, after the pressure piston 5 has been withdrawn, by the use of a knock out pin 6.

Using a high pressure casting device of the above type, Mo was chosen as the first metal to be alloyed, and Al was chosen as the second metal, and a Mo-Al alloy in which an oxide of Al, i.e. $Al_2O_3$, was finely dispersed, was made as follows.

First, a quantity of $MoO_3$ powder metal having a nominal composition of 98% $MoO_3$ by weight and a nominal average particle diameter of 44 microns was subjected to compression forming at a pressure of about 600 kg/cm$^2$, so as to form a porous preform, made substantially of $MoO_3$ and with a bulk density of about 2.35 gm/cc , with dimensions about 15 mm by 15 mm by 80 mm.

Next, a casting process was performed on the preform, as schematically shown in section in FIG. 1 wherein said preform is designated by the reference numeral 2. After it had been heated up to 600° C. at atmospheric pressure, the preform 2 was placed into the mold cavity 4 of the casting mold 1 which itself was at this time heated up to 250° C., and then a quantity 3 of molten metal for serving as an alloy metal and for forming an oxide, in the case of this first preferred embodiment being molten substantially pure aluminum of nominal purity 99.7% by weight and being heated to about 800° C., was poured into the mold cavity 4 over and around the preform 2. Then the piston 5, which closely cooperated with the defining surface of the mold cavity 4, was forced into said mold cavity 4 and was forced inwards, so as to pressurize the molten aluminum metal mass 3 to a pressure of about 500 kg/cm$^2$ and thus to force it into the interstices between the $MoO_3$ particles making up the porous preform 2. It is believed that at this time, as the molten aluminum metal thus percolated through the porous preform 2, by the great affinity of aluminum for oxygen much of the $MoO_3$ was reduced to produce Mo metal which became mixed and alloyed with the molten aluminum, while the oxygen thus abstracted from the $MoO_3$ became combined by oxidization with a certain portion of the molten aluminum metal to form extremely fine particles of $Al_2O_3$. The pressure of about 500 kg/cm$^2$ was maintained until the mass 3 of molten aluminum metal was completely solidified, and then the resultant cast form was removed from the mold cavity 4 by the use of the knock out pin 6. Finally, the part of this cast form which consisted only of aluminum metal was machined away, and from the part of said cast form in which the porous preform 2 had been embedded was cut a cuboidal test piece of Mo-Al alloy in which fine particles of $Al_2O_3$ were dispersed.

Figure 2:
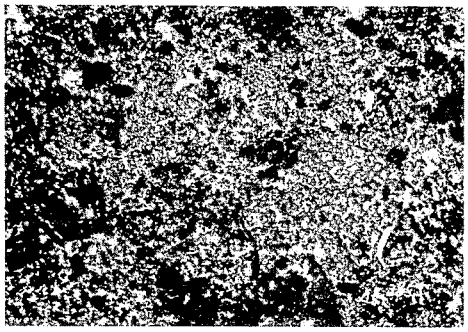
FIG. 2 is an optical photomicrograph of a section of an Mo-Al alloy with included $Al_2O_3$ particles manufactured according to said first preferred embodiment of the method of the present invention using the FIG. 1 apparatus, magnified 100X.

FIG. 2 is an optical photomicrograph of a section of this Mo-Al alloy manufactured as described above, magnified 100X times. In this figure, the whitish portions are portions of the Mo-Al alloy phase, while the grey portions are portions which have a structure of a mixture of $Al_2O_3$ and Al. From this FIG. 2, it will be seen that, according to this first preferred embodiment of the present invention, it has been possible to manufacture a Mo-Al alloy (which had macro composition about 42% by weight of Mo, about 37% by weight of Al, and about 21% by weight of O, with the proportion of $Al_2O_3$ being about 44.6% by weight) with an even and fine structure, with the particles of $Al_2O_3$ finely dispersed in the alloy material.

Figure 3:
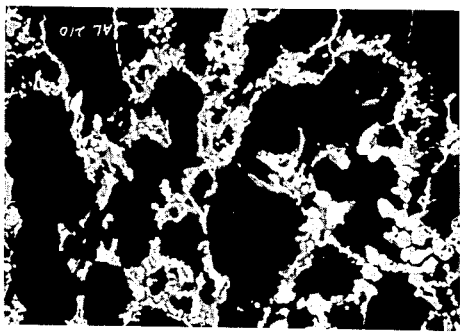
FIG. 3 is an EPMA secondary electron image of said Mo-Al alloy at a magnification of 1000X.
Figure 4:
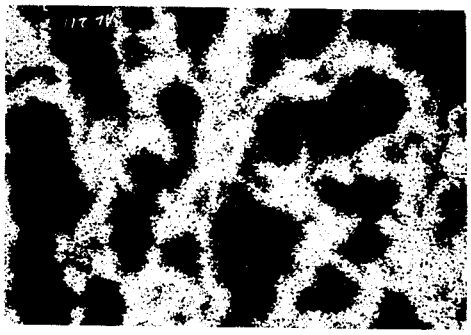
FIG. 4 is an Mo surface analysis photograph of said Mo-Al alloy at a magnification of 1000X.
Figure 5:
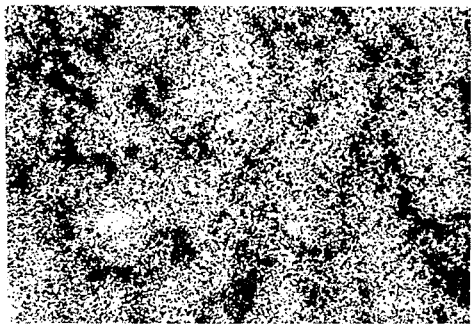
FIG. 5 is an Al surface analysis photograph of said Mo-Al alloy at a magnification of 1000X.
Figure 6:
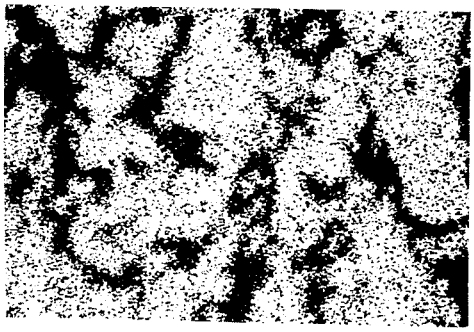
FIG. 6 is an O surface analysis photograph of said Mo-Al alloy at a magnification of 1000X.

Further, EPMA analysis and X-ray diffraction tests were carried out on the Mo-Al alloy manufactured as described above. The EPMA analysis results are shown in FIGS. 3 through 6. With regard to these figures, FIG. 3 is an EPMA secondary electron image at a magnification 0f 1000X, FIG. 4 is a Mo surface analysis photograph at a magnification of 1000X, FIG. 5 is an Al surface analysis photograph at a magnification of 1000X, and FIG. 6 is an O surface analysis photograph at a magnification of 1000X. In FIG. 3, the whitish portions are portions of the Mo-Al alloy phase, while the black portions are portions which have a structure of a mixture of $Al_2O_3$ and Al. And in FIGS. 4 through 6 the whitish portions are the portions which respectively consist of Mo, Al, and O. As will be apparent from these FIGS. 3 through 6, from the results of the EPMA analysis and the X-ray diffraction tests, it was confirmed that within the structure of the Mo-Al alloy manufactured as described above there were portions of the Mo-Al alloy phase and other portions made of fine particles of $Al_2O_3$, formed by the oxidization of the Al which was forced in molten form through the interstices of the porous $MoO_3$ preform by the reduction of the $MoO_3$ to produce oxygen, said fine particles of $Al_2O_3$ being dispersed finely and evenly within the Mo-Al alloy mass.

When this alloy was tested, it was confirmed that its strength, its heat resistance, and its anti wear characteristic were excellent.

Although no specific details about such matters will be given here in the interests of brevity of description, in fact, when a sequence of porous preforms were made in substantially the same way as described above but using as material (instead of $MoO_3$): $V_2O_5$, $WO_3$, $Fe_2O_3$, $MnO_2$,CoO, $Nb_2O_5$, $Ta_2O_5$, $TiO_2$, $Cr_2O_3$, and NiO, and when the same casting process as described above was performed in each case, again using pure aluminum as a molten metal for alloying, it was confirmed that substantially parallel results were obtained: in each case, in addition to alloy phase portions made out of the Al metal alloyed with the metal of the preform which had been reduced from the oxide of which it had been composed, there were fine $Al_2O_3$ particles dispersed in the alloy, made out of the Al alloy metal oxidized by the oxygen which had been reduced from the oxide of which the preform has been composed.

When each of these alloys was tested, again it was confirmed that its strength, its heat resistance, and its anti wear characteristic were excellent.

THE SECOND PREFERRED EMBODIMENT

MOLTEN Zn-Al ALLOY COMPOUNDED INTO CoO

Figure 7:
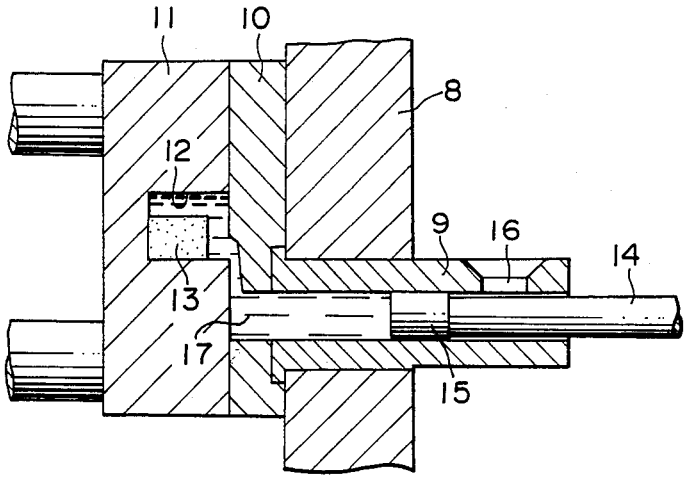
FIG. 7 is a schematic vertical sectional view taken through a cold chamber type die-cast casting device, showing a pair of dies with a mold cavity defined between them and a plunger which is being forced into a hole in a casting sleeve communicated with said mold cavity in order to pressurize molten metal around a preform which is being received in said mold cavity, during a casting stage of manufacture of a material according to the second preferred embodiment of the method of the present invention.

FIG. 7 is a schematic vertical sectional view taken through a cold chamber type die-cast casting device used in the second preferred embodiment of the present invention. In this figure, the reference numeral 8 denotes a die fitting plate, to which are fixed a casting sleeve 9 and a fixed die 10. The fixed die 10 cooperates with a movable die 11 which is reciprocated to and fro in the horizontal direction as seen in FIG. 7 by a ram device or the like not shown in the figure, and a mold cavity 12 is defined by this cooperation of the fixed die 10 and the movable die 11. A plunger 15 fixed at the end of a plunger rod 14 cooperates with a cylindrical hole formed in the casting sleeve 9, and the plunger rod 14 and the plunger 15 can be selectively pressed leftwards as seen in the figure by a means, also not shown, so as to apply pressure to a quantity 17 of molten metal which is being received in the mold cavity 12 as surrounding a preform 13 made of porous material previously placed in said mold cavity 12 (this quantity 17 of molten metal is first poured into the mold cavity 12 through a hole 16 pierced through the upper side of the casting sleeve 9). When the quantity 17 of molten metal has solidified, the resulting cast piece is removed from the mold cavity 12, after the plunger rod 14 and the plunger 15 have been withdrawn, by separating the fixed die 10 and the movable die 11, with the aid of a knock out pin not shown in the figure.

Using a die-cast casting device of the above type, Co was chosen as the first metal to be alloyed, and Zn with an admixture of Al was chosen as the second metal, and a Co-Zn-Al alloy in which an oxide of Al, i.e. $Al_2O_3$, was finely dispersed, was made as follows.

First, a quantity of CoO powder material having a nominal composition of 97% CoO by weight and a nominal average particle diameter of 10 microns was subjected to compression forming at a pressure of about 750 kg/cm$^2$, so as to form a porous preform, made substantially of CoO and with a bulk density of about 3.2 gm/cc , with dimensions about 15 mm by 15 mm by 80 mm.

Next, a casting process was performed on the preform, as schematically shown in section in FIG. 7 wherein said preform is designated by the reference numeral 13. After it had been heated up to 400° C. at atmospheric pressure, the preform 13 was placed into the mold cavity 12 of the movable die 11 which itself was at this time heated up to 200° C., and then a quantity 17 of molten metal for serving as an alloy metal and for forming an oxide, in the case of this second preferred embodiment being molten alloy of about 70% by weight of Zn and about 30% by weight of Al and being heated to about 600° C., was poured into the mold cavity 12 over and around the preform 13. Then the plunger rod 14 and the plunger 15, which closely cooperated with the inner cylindrical surface of the casting sleeve 9, were forced into said mold cavity 12 and were forced inwards, so as to pressurize th molten Zn-Al alloy metal mass 17 to a pressure of about 500 kg/cm$^2$ and thus to force it into the interstices between the CoO particles making up the porous preform 13. It is believed that at this time, as the molten Zn-Al alloy metal mass thus percolated through the porous preform 13, by the great affinity of aluminum for oxygen much of the CoO was reduced to produce Co metal which became mixed and alloyed with the molten Zn-Al alloy, while the oxygen thus abstracted from the CoO became combined by oxidization with a certain portion of the molten aluminum metal to form extremely fine particles of $Al_2O_3$. The pressure of about 500 kg/cm$^2$ was maintained until the mass 17 of molten Zn-Al alloy metal was completely solidified, and then the resultant cast form was removed from the mold cavity 12 by separating the fixed die 10 and the movable die 11, and by the use of the knock out pin not shown in the drawing. Finally, the part of this cast form which consisted only of Zn-Al alloy metal was machined away, and from the part of said cast form in which the porous preform 13 had been embedded was cut a cuboidal test piece of Co-Zn-Al alloy in which fine particles of $Al_2O_3$ were dispersed.

Figure 8:
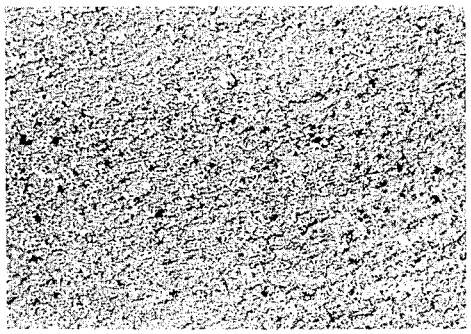
FIG. 8 is an optical photomicrograph of a section of a Co-Zn-Al alloy with included $Al_2O_3$ particles manufactured according to said second preferred embodiment of the method of the present invention using the FIG. 7 apparatus, magnified 400X.

FIG. 8 is an optical photomicrograph of a section of this Co-Zn-Al alloy manufactured as described above, magnified 400X times. In this figure, the whitish portions are portions of the Co-Zn-Al alloy phase, while the grey portions are portions which have a structure of a mixture of $Al_2O_3$ and Zn-Al alloy. From this FIG. 8, it will be seen that, according to this second preferred embodiment of the present invention, it has been possible to manufacture a Co-Zn-Al alloy (which had macro composition about 41% by weight of Co, about 33% by weight of Zn, about 14% by weight of Al, and about 12% by weight of O, with the proportion of $Al_2O_3$ being about 25.5% by weight) with an even and fine structure, with the particles of $Al_2O_3$ finely dispersed in the alloy material.

Further, EPMA analysis and X-ray diffraction tests were carried out on the Co-Al alloy manufactured as described above. The results of these analyses are not particularly shown; however, it was confirmed that the CoO had been reduced by the Al, and that within the structure of the Co-Zn-Al alloy manufactured as described above there were portions of the Co-Zn-Al alloy phase and other portions made of fine particles of $Al_2O_3$, formed by the oxidation of a portion of the Al in the Zn-Al alloy which was forced in molten form through the interstices of the porous CoO preform by the reduction of the CoO to produce oxygen, said fine particles of $Al_2O_3$ being dispersed finely and evenly within the Co-Zn-Al alloy mass.

When this alloy was tested, it was confirmed that its strength and its heat resistance characteristic were excellent.

Although no specific details about such matters will be given here in the interests of brevity of description, in fact, when a sequence of porous preforms were made in substantially the same way as described above but using as material (instead of CoO): $V_2O_5$, $WO_3$, $Fe_2O_3$, $MnO_2$, $Nb_2O_5$, $Ta_2O_5$, $TiO_2$, $Cr_2O_3$, and NiO, and when the same casting process as described above was performed in each case, again using molten alloy of about 70% by weight of Zn and about 30% by weight of Al as a molten metal for alloying, it was confirmed that substantially parallel results were obtained: in each case, in addition to alloy phase portions made out of the Zn-Al alloy further alloyed with the metal of the preform which had been reduced from the oxide of which it had been composed, there were fine $Al_2O_3$ particles dispersed in the alloy, made out of the Al portion of the alloy metal oxidized by the oxygen which had been reduced from the oxide of which the preform had been composed.

When each of these alloys was tested, again it was confirmed that its strength and its heat resistance characteristic were excellent.

THE THIRD PREFERRED EMBODIMENT

MOLTEN Zn METAL COMPOUNDED INTO $MnO_2$

Figure 9:
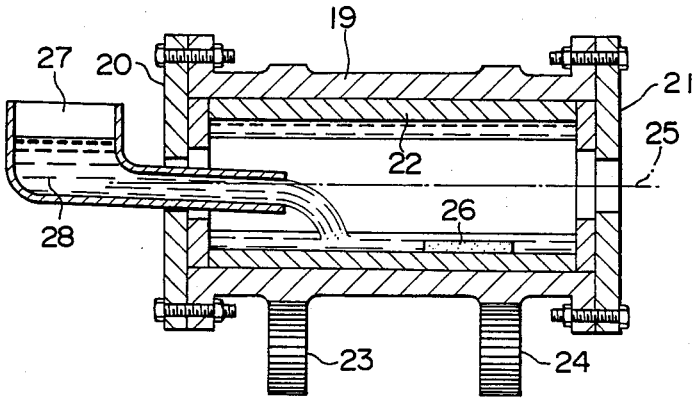
FIG. 9 is a schematic vertical sectional view taken through a horizontal centrifugal type casting device, showing a cylindrical casting drum in which there is disposed a cylindrical mold within which a mold cavity is defined, said drum and mold being rotatable in order to pressurize molten metal around a preform which is being received in said mold cavity, during a casting stage of manufacture of a material according to the present invention according to the third preferred embodiment of the method of the present invention.

FIG. 9 is a schematic vertical sectional view taken through a horizontal centrifugal type casting device used in the third preferred embodiment of the present invention. In this figure, the reference numeral 19 denotes a cylindrical casting drum closed at both its ends by end walls 20 and 21. Within this casting drum 19 there is disposed a cylindrical mode 22 within which a mold cavity is defined; this mold 22 can be selectively either attached to or removed from the casting drum 19. The casting drum 19 is rotatably mounted on rollers 23 and 24, and via these rollers 23 and 24 can selectively be rotated about its central axis 15 at high speed by an electric motor or the like not shown in the figures, so as to apply centrifugally generated pressure to a quantity 28 of molten metal which is being received in the mold cavity of the mold 22 as surrounding a preform 26 made of porous material previously placed in said mold cavity (this quantity 28 of molten metal is first poured into the mold cavity of the mold 22 through a funnel 27 passed through a central hole formed in the end wall 20). When the quantity 28 of molten metal has solidified, the resulting cast piece is removed from the mold cavity of the mold 22, after the spinning of the casting drum 19 and the mold 22 have been stopped, by separating the mold 22 and the casting drum 19.

Using a horizontal centrifugal type casting device of the above type, Mn was chosen as the first metal to be alloyed, and Zn was chosen as the second metal, and a Mn-Zn alloy in which an oxide of Zn, i.e. ZnO, was finely dispersed, was made as follows.

First, a quantity of $MnO_2$ powder material having a nominal composition of 91% $MnO_2$ by weight and a nominal average particle diameter of 10 microns was subjected to compression forming at a pressure of about 1500 kg/cm$^2$, so as to form a porous preform, made substantially of $MnO_2$ and with a bulk density of about 2.0 gm/cc , with dimensions about 15 mm by 15 mm by 80 mm.

Next, a casting process was performed on the preform, as schematically shown in section in FIG. 9 wherein said preform is designated by the reference numeral 26. After a steel weight had been attached to the preform 26 to weight it down, and after it had been heated up to 800° C. at atmospheric pressure, the preform 26 was placed into the mold cavity of the mold 22 (the inner diameter of this mold cavity was 100 mm) which itself was at this time heated up to 100° C., and then a quantity 28 of molten metal for serving as an alloy metal and for forming an oxide, in the case of this third preferred embodiment being molten zinc of nominal purity 99.3% by weight and being heated to about 550° C., was poured into the mold cavity of the mold 22 over and around the preform 26. Then the casting drum 19 and the mold 22 were rotated by the rollers 23 and 24 at a rotational speed of about 200 rpm, so as to pressurize the molten Zn metal mass 28 and thus to force it into the interstices between the $MnO_2$ particles making up the porous preform 26. It is believed that at this time, as the molten Zn metal mass thus percolated through the porous preform 26, by the great affinity of zinc for oxygen much of the $MnO_2$ was reduced to produce Mn metal which became mixed and alloyed with the molten Zn metal to form an alloy, while the oxygen thus abstracted from the $MnO_2$ became combined by oxidization with a certain portion of the molten Zn metal to form extremely fine particles of ZnO. The spinning of the casting drum 19 and the mold 22 was maintained until the mass 28 of molten Zn metal was completely solidified, and then the resultant cast form was removed from the mold cavity of the mold 22 by separating the mold 22 and the casting drum 19. Finally, the part of this cast form which consisted only of Zn metal was machined away, and from the part of said cast form in which the porous preform 26 had been embedded was cut a cuboidal test piece of Mn-Zn alloy in which fine particles of ZnO were dispersed.

Figure 10:
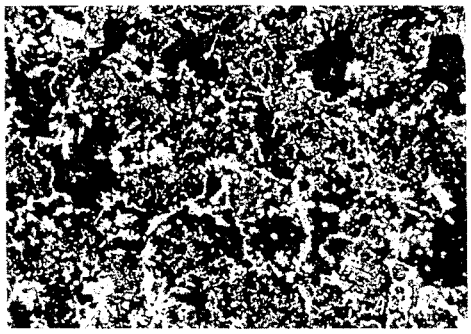
FIG. 10 is an optical photomicrograph of a section of a Mn-Zn alloy with included ZnO particles manufactured according to said third preferred embodiment of the method of the present invention using the FIG. 7 apparatus, magnified 400X.

FIG. 10 is an optical photomicrograph of a section of this Mn-Zn alloy manufactured as described above, magnified 400X times. In this figure, the whitish portions are portions of the Mn-Zn alloy phase, while the grey portions are portions which have a structure of a mixture of ZnO and Zn metal. From this FIG. 10, it will be seen that, according to this third preferred embodiment of the present invention, it has been possible to manufacture a Mn-Zn alloy (which had macro composition about 20% by weight of Mn, about 68.2% by weight of Zn, and about 11.8% by weight of O, with the proportion of ZnO being about 60% by weight) with an even and fine structure, with the particles of ZnO finely dispersed in the alloy material.

Further, EPMA analysis and X-ray diffraction tests were carried out on the Mn-Zn alloy manufactured as described above. The results of these analyses are not particularly shown; however, it was confirmed that the $MnO_2$ had been reduced by the Zn, and that within the structure of the Mn-Zn alloy manufactured as described above there were portions of the Mn-Zn alloy phase and other portions made of fine particles of ZnO, formed by the oxidization of a portion of the Zn in the Zn-Mn alloy which was forced in molten form through the interstices of the porous $MnO_2$ preform by the reduction of the $MnO_2$ to produce oxygen, said fine particles of ZnO being dispersed finely and evenly within the Zn mass.

When this alloy was tested, it was confirmed that its heat resistance and its frictional characteristics were excellent.

Although no specific details about such matters will be given here in the interests of brevity of description, in fact, when two porous preforms were made in substantially the same way as described above but using as material (instead of $MnO_2$) PbO powder and CuO powder, and when the same casting process as described above was performed in each case, again using molten Zn metal as a melt metal for alloying, it was confirmed that substantially parallel results were obtained: in each case, in addition to alloy phase portions made out of the Zn metal further alloyed with the metal of the preform which had been reduced from the oxide of which it had been composed, there were fine ZnO particles dispersed in the alloy, made out of some of the Zn alloy metal oxidized by the oxygen which had been reduced from the oxide of which the preform had been composed.

When each of these alloys was tested, again it was confirmed that its characteristics were excellent.

THE FOURTH PREFERRED EMBODIMENT

MOLTEN Mg METAL COMPOUNDED INTO $MnO_2$

Using a high pressure casting device of the same type as used in the case of the first preferred embodiment, i.e. of the FIG. 1 type, Mn was chosen as the first metal to be alloyed, and Mg was chosen as the second metal, and a Mn-Mg alloy in which an oxide of Mg, i.e. MgO, was finely dispersed, was made as follows.

First, a quantity of $MnO_2$ powder material having a nominal composition of 95% $MnO_2$ by weight and a nominal average particle diameter of 1.57 microns was subjected to compression forming at a pressure of about 800 kg/cm$^2$, so as to form a porous preform, made substantially of $MnO_2$ and with a bulk density of about 2.0 gm/cc , with dimensions about 15 mm by 15 mm by 80 mm.

Next, a casting process was performed on the preform, similarly to the casting done in the case of the first preferred embodiment described above, by heating it up to a temperature of 200° C. at atmospheric pressure, by then placing it into the mold cavity of the casting mold which itself was at this time heated up to 200° C., and then by pouring a quantity of molten metal for serving as an alloy metal and for forming an oxide, in the case of this fourth preferred embodiment this molten metal being substantially pue Mg of nominal purity 99.8% by weight and being heated to about 750° C., into the mold cavity over and around the preform. And next a pressure piston was forced into said mold cavity so as to pressurize the molten Mg metal mass to a pressure of about 1000 kg/cm$^2$ and thus to force it into the interstices between the $MnO_2$ particles making up the porous preform. Again, it is believed that at this time, as the molten Mg metal thus percolated through the porous preform, by the great affinity of Mg for oxygen much of the $MnO_2$ was reduced to produce Mn metal which became mixed and alloyed with the molten Mg, while the oxygen thus abstracted from the $MnO_2$ became combined by oxidization with a certain portion of the molten Mg metal to form extremely fine particles of MgO. The pressure was maintained until the mass of molten Mg metal was completely solidified, and then the resultant cast form was removed from the mold cavity by the use of a knock out pin, the part of this cast form which consisted only of Mg metal was machined away, and from the part of said cast form in which the porous preform had been embedded was cut a cuboidal test piece of Mn-Mg alloy in which fine particles of MgO were dispersed.

Figure 11:
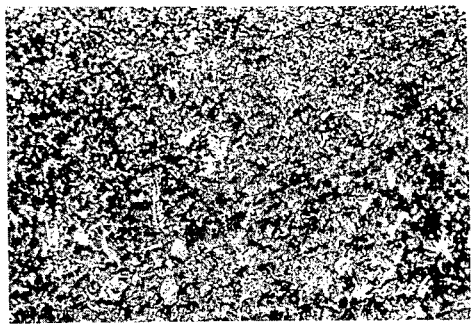
FIG. 11 is an optical photomicrograph of a section of a Mn-Mg alloy with included MgO particles manufactured according to a fourth preferred embodiment of the present invention using the FIG. 1 apparatus, magnified 400X.

FIG. 11 is an optical photomicrograph of a section of this Mn-Mg alloy manufactured as described above, magnified 400X times. In this figure, the whitish portions are portions of the Mn-Mg alloy phase, while the grey portions are portions which have a structure of a mixture of MgO and Mg. From this FIG. 11, it will be seen that, according to this fourth preferred embodiment of the present invention, it has been possible to manufacture a Mn-Mg alloy (which had macro composition about 35.6% by weight of Mn, about 43.4% by weight of Mg, and about 21% by weight of O, with the proportion of MgO being about 52.5% by weight) with an even and fine structure, with the particles of MgO finely dispersed in the alloy material.

Further, EPMA analysis and X-ray diffraction tests were carried out on the Mn-Mg alloy manufactured as described above. The results of these tests are not particularly shown; however, it was confirmed that within the structure of the Mn-Mg alloy manufactured as described above there were portions of the Mn-Mg alloy phase and other portions made of fine particles of MgO, formed by the oxidization of a part of the Mg which was forced in molten form through the interstices of the porous $MnO_2$ preform by the reduction of the $MnO_2$ to produce oxygen, said fine particles of MgO being dispersed finely and evenly within the Mn-Mg alloy mass.

When this alloy was tested, it was confirmed that its strength, its heat resistance, and its anti wear characteristic were excellent.

Although no specific details about such matters will be given here in the interests of brevity of description, in fact, when a sequence of porous preforms were made in substantially the same way as described above but using as material (instead of $MnO_2$): $V_2O_5$, $WO_3$, $Fe_2O_3$, $MoO_3$, $MnO_2$, CoO, $Nb_2O_5$, $Ta_2O_5$, $TiO_2$, $Cr_2O_3$, and NiO, and when the same casting process as described above was performed in each case, again using pure Mg as a molten metal for alloying, it was confirmed that substantially parallel results were obtained: in each case, in addition to alloy phase portions made out of the Mg metal alloyed with the metal of the preform which had been reduced from the oxide of which it had been composed, there were fine MgO particles dispersed in the alloy, made out of the Mg alloy metal oxidized by the oxygen which had been reduced from the oxide of which the preform had been composed.

When each of these alloys was tested, again it was confirmed that its strength, its heat resistance, and its anti wear characteristic were excellent.

THE FIFTH PREFERRED EMBODIMENT

MOLTEN Mg METAL COMPOUNDED INTO Ti POWDER WITH SURFACE $TiO_2$

Using a high pressure casting device of the same type as used in the case of the first preferred embodiment, i.e. of the FIG. 1 type, Ti was chosen as the first metal to be alloyed, and Mg was chosen as the second metal, and a Ti-Mg alloy in which an oxide of Mg, i.e. MgO, was finely dispersed, was made as follows.

First, a quantity of Ti powder material having a nominal composition of 97.6% $TiO_2$ by weight and a nominal average particle diameter of 10 microns was heated in the atmosphere to a temperature of about 250° C. and was kept at this temperature for about five minutes, so that the surface of the powder was oxidized in such a way that the powder surface oxygen amount was 3.53% by weight. Next, this powder of Ti and $TiO_2$ was subjected to compression forming at a pressure of about 1200 kg/cm$^2$, so as to form a cylindrical porous preform with a bulk density of about 1.6 gm/cc with diameter about 80 mm and height about 10 mm.

Next, a casting process was performed on the preform, similarly to the casting done in the case of the first preferred embodiment described above, by heating it up to a temperature of 600° C. this time in a vacuum furnace, by then placing it into the mold cavity of the casting mold which itself was at this time heated up to 200° C., and then by pouring a quantity of molten metal for serving as an alloy metal and for forming an oxide, in the case of the first preferred embodiment this molten metal being substantially pure Mg of nominal purity 99.7% by weight and being heated to about 800° C., into the mold cavity over and around the preform. And next a pressure piston was forced into said mold cavity so as to pressurize the molten Mg metal mass to a pressure of about 1500 kg/cm$^2$ and thus to force it into the interstices between the particles making up the porous preform. Again, it is believed that at this time, as the molten Mg metal thus percolated through the porous preform, by the great affinity of Mg for oxygen much of the $TiO_2$ was reduced to produce Ti metal which became mixed and alloyed with the molten Mg, while the oxygen thus abstracted form the $TiO_2$ became combined by oxidization with a certain portion of the molten Mg metal to form extremely fine particles of MgO. The pressure was maintained until the mass of molten Mg metal was completely solidified, and then the resultant cast form was removed from the mold cavity by the use of a knock out pin, the part of this cast form which consisted only of Mg metal was machined away, and from the part of said cast form in which the porous preform had been embedded was cut a cuboidal test piece of Ti-Mg alloy in which fine particles of MgO were dispersed.

Figure 12:
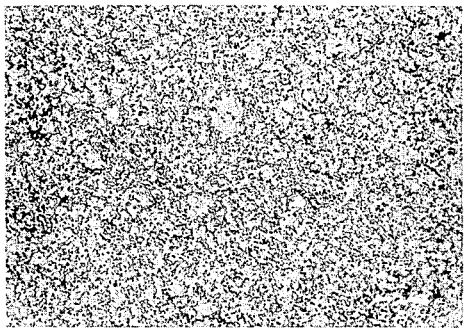
FIG. 12 is an optical photomicrograph of a section of a Ti-Mg alloy with included MgO particles manufactured according to a fifth preferred embodiment of the present invention using the FIG. 1 apparatus, magnified 400X.

FIG. 12 is an optical photomicrograph of a section of this Ti-Mg alloy manufactured as described above, magnified 400X times. In this figure, the scattered white island portions are Mg, the scattered grey particles are Ti, and the background grey portions are portions of the Ti-Mg alloy phase. From this FIG. 12, it will be seen that, according to this fifth preferred embodiment of the present invention, it has been possible to manufacture a Ti-Mg alloy (which had macro composition about 46.7% by weight of Ti, about 51.6% by weight of Mg, and about 1.6% by weight of O, with the proportion of MgO being about 4.2% by weight) with an even and fine structure, with the particles of MgO finely dispersed in the alloy material.

Further, EPMA analysis and X-ray diffraction tests were carried out on the Ti-Mg alloy manufactured as described above. The results of these tests are not particularly shown; however, it was not possible to confirm the existence of MgO particles in the Ti-Mg alloy because the amount of $TiO_2$ was small in the first place and accordingly the absolute amount of reaction betwen the $TiO_2$ and the Mg was slight: but it was confirmed that the process of alloying proceeded better than in the case where a Ti-Mg alloy was manufactured in the same way as described above but only using pure Ti powder for making the preform without first oxidizing its surface. Thus, although it was unconfirmed by experiment, it is strongly conjectured that that within the structure of the Ti-Mg alloy manufactured as described above there were portions of the Ti-Mg alloy phase and other portions made of fine particles of MgO, formed by the oxidization of a part of the Mg which was forced in molten form through the interstices of the porous $TiO_2$ preform by the reduction of the $TiO_2$ to produce oxygen, said fine particles of MgO being dispersed finely and evenly within the Ti-Mg alloy mass. And it is conjectured that the heat generated by this reduction oxidation reaction helped to promote the good alloying of the Ti and the Mg.

When this alloy was tested, it was confirmed that its tensile strength was about 40 kg/mm$^2$ at a temperature of 350° C., and accordingly that its high temperature tensile strength was excellent.

Although no specific details about such matters will be given here in the interests of brevity of description, in fact, when a sequence of porous preforms were made in substantially the same way as described above but using as the original metallic powder material (instead of Ti): Fe, Ni, Co, V, W, Nb, and Ta, and when after applying forced oxidization to the surfaces of these powder materials the above described casting process was performed in each case, again using pure Mg as a molten metal for alloying, it was confirmed that substantially parallel results were obtained: in each case, it was confirmed that the alloying process proceeded better than in a comparison experiment wherein the surface of the metallic powder material was not forcibly oxidized.

When each of these alloys was tested, again it was confirmed that its tensile strength and its anti wear characteristic were excellent.

From this fifth preferred embodiment, therefore, it is understood that the material constituting the porous preform need not be entirely a metal oxide, and that it is sufficent for merely the surfaces of the fine powder particles which are included in this preform to be oxidized, and that in this case an oxidization reduction reaction takes place between these metal oxide surfaces and the melt metal, thus producing heat which promotes alloying.

THE SIXTH PREFERRED EMBODIMENT

MOLTEN Al METAL COMPOUNDED INTO MIXED $Fe_2O_3$ AND Ni POWDERS

Using a high pressure casting device of the same type used in the case of the first preferred embodiment, i.e. of the FIG. 1 type, a Ni-Fe-Al alloy in which an oxide of Al, i.e. $Al_2O_3$, was finely dispersed, was made as follows.

First, a quantity of $Fe_2O_3$ powder material having a nominal composition of 98% $Fe_2O_3$ by weight and a nominal average particle diameter of 44 microns was mixed together with a quantity of Ni powder of nominal purity 99.7% by weight and having a nominal average particle diameter of 25 microns, the relative proportions of these powders being 5.1:44.5 by weight; and next the mixture powder was subjected to compression forming at a pressure of about 1100 kg/cm$^2$, so as to form a porous preform, made substantially of $Fe_2O_3$ and Ni and with a bulk density of about 5.0 gm/cc, with dimensions about 15 mm by 15 mm by 80 mm.

Next, a casting process was performed on the preform, similarly to the casting done in the case of the first preferred embodiment described above, by, after fixing steel weights to the preform, heating it up to a temperature of 600° C. in a vacuum, by then placing it into the mold cavity of the casting mold which itself was at this time heated up to 300° C., and then by pouring a quantity of molten metal for serving as an alloy metal and for forming an oxide, in the case of this sixth preferred embodiment this molten metal being substantially pure Al of nominal purity 99.7% by weight and being heated to about 800° C., into the mold cavity over and around the preform. And next a pressure piston was forced into said mold cavity so as to pressurize the molten Al metal mass to a pressure of about 1000 kg/cm$^2$ and thus to force it into the interstices between the $Fe_2O_3$ and Ni particles making up the porous preform. Again, it is believed that at this time, as the molten Al metal thus percolated through the porous preform, by the great affinity of Al for oxygen much of the material of the $Fe_2O_3$ particles was reduced to produce Fe metal which became mixed and alloyed with the molten Al metal, along with some of the Ni metal of the Ni particles, while the oxygen thus abstracted from the $Fe_2O_3$ became combined by oxidization with a certain portion of the molten Al metal to form extremely fine particles of $Al_2O_3$. The pressure was maintained until the mass of molten Al metal was compleely solidified, and then the resultant cast form was removed from the mold cavity by the use of a knock out pin, the part of this cast form which consisted only of Al metal was machined away, and from the part of said cast form in which the porous preform had been embedded was cut a cuboidal test piece of Ni-Fe-Al alloy in which fine particles of $Al_2O_3$ were dispersed.

Figure 13:
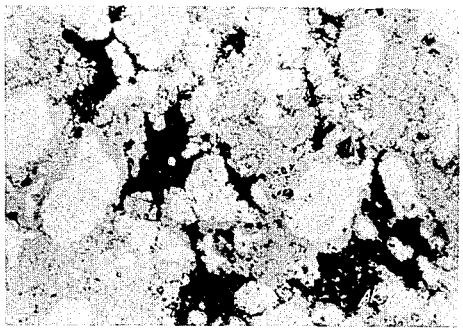
FIG. 13 is an optical photomicrograph of a section of a Ni-Fe-Al alloy with included $Al_2O_3$ particles manufactured according to a sixth preferred embodiment of the present invention using the FIG. 1 apparatus, magnified 400X.

FIG. 13 is an optical photomicrograph of a section of the Ni-Fe-Al alloy manufactured as described above, magnified 400X times. In this figure, the whitish portions are Ni, the bright grey portions are portions of the Ni-Fe-Al alloy phase, while the dark grey portions are portions which have a structure of a mixture of $Al_2O_3$ and Al. From this FIG. 13, it will be seen that, according to this sixth preferred embodiment of the present invention, it has been possible to manufacture a Ni-Fe-Al alloy (which had macro composition about 69.4% by weight of Ni, about 9.4% by weight of Fe, about 17.0% by weight of Al, and about 4.2% by weight of O, with the proportion of $Al_2O_3$ being about 9.0% by weight) with an even and fine structure, with the particles of $Al_2O_3$ finely dispersed in the alloy material.

Further, EPMA analysis and X-ray diffraction tests were carried out on the Ni-Fe-Al alloy manufactured as described above. The results of these tests are not particularly shown; however, it was confirmed that within the structure of the Ni-Fe-Al alloy manufactured as described above there were portions of Ni only, portions of a Fe-Al alloy phase, and portions of an Ni-Fe-Al alloy phase, and further other portions made of fine particles of $Al_2O_3$, formed by the oxidization of a part of the Al which was forced in molten form through the interstices of the porous $Fe_3O_3$ powder and Ni powder preform by the reduction of the $Fe_2O_3$ to produce oxygen, said fine particles of $Al_2O_3$ being dispered finely and evenly within the Al.

When this alloy was tested, it was confirmed that its strength, its heat resistance, and its anti wear characteristic were excellent. Further, when a series of hardness tests were carried out on this alloy, the following results were obtained: at room temperature, the micro Vickers hardness Hv was 648; at 350° C., the hardness Hv was 609; at 550° C., the hardness Hv was 542; and at 650° C., the hardness Hv was 489.

Although no specific details about such matters will be given here in the interests of brevity of description, in fact, when a sequence of porous preforms were made in substantially the same way as described above but using as material to be mixed with the Ni powder (instead of $Fe_2O_3$ powder): $V_2O_5$, $WO_3$, $MoO_3$, $Nb_2O_5$, $TiO_2$, $Cr_2O_3$, $MnO_2$, and NiO, and when the same casting process as described above was performed in each case, again using pure Al as a molten metal for alloying, it was confirmed that substantially parallel results were obtained: in each case, in addition to alloy phase portions made out of the Al metal and the N1 metal alloyed with the metal of the preform which had been reduced from the oxide of which it had been composed, there were fine $Al_2O_3$ particles dispersed in the alloy, made out of the Al alloy metal oxidized by the oxygen which had been reduced from the oxide of which the preform had been composed. Further, when another sequence of porous preforms were made in substantially the same way as described above but using as material to be mixed with the $Fe_2O_3$ powder (instead of Ni powder): Ti, Fe, Co, Nb, Ta, W, Mo, or Mn powder, and when the same casting process as described above was performed in each case, again using pure Al as a molten metal for alloying, it was confirmed that substantially parallel results, mutatis mutandis, were obtained in those cases also.

When each of these alloys was tested, again it was confirmed that its strength, its heat resistance, and its anti wear characteristic were excellent.

From this sixth preferred embodiment, it can be seen that also in the case when the porous solid preform used is made up of a mixture of a metallic powder and metal oxide, both in a finely powdered form, the oxidization-reduction reaction that occurs between the metal oxide and the molten metal pressurized around said preform proceeds properly, and it is possible to manufacture an alloy including finely and uniformly dispersed particles of the oxide of the metal which was molten dispersed in it.

THE SEVENTH PREFERRED EMBODIMENT

MOLTEN Al METAL COMPOUNDED INTO $Co_2SiO_4$

Using a high pressure casting device of the same type as used in the case of the first preferred embodiment, i.e. of the FIG. 1 type, a Co-Si-Al alloy in which particles of an oxide of Al, i.e. $Al_2O_3$, and particles of an oxide of Si, i.e. $SiO_2$, were finely dispersed, was made as follows.

First, a quantity of $Co_2SiO_4$ powder made having a nonimal composition of composition of 99.2% $Co_2SiO_4$ by weight and a nominal average particle diameter of 5 microns was subjected to compression forming at a pressure of about 1400 kg/cm$^2$, so as to form a cylindrical porous preform, made substantially of $Co_2SiO_4$ and with a bulk density of about 2.3 gm/cc , with diameter about 80 mm and height about 10 mm.

Next, a casting process was performed on the preform, similarly to the casting done in the case of the first preferred embodiment described above, but omitting any preheating step, by placing it into the mold cavity of the casting mold which itself was at this time heated up to 200° C., and then by pouring a quantity of molten metal for serving as an alloy metal and for forming an oxide, in the case of this seventh preferred embodiment this molten metal being substantially pure Al of nominal purity 99.7% by weight and being heated to about 800° C., into the mold cavity over and around the preform. And next a pressure piston was forced into said mold cavity so as to pressurize the molten Al metal mass to a pressure of about 1000 kg/cm$^2$ and thus to force it into the interstices between the $Co_2SiO_4$ particles making up the porous preform. Again, it is believed that at this time, as the molten Al metal thus percolated through the porous preform, by the great affinity of Al for oxygen much of the $Co_2SiO_4$ was reduced to produce Co and Si metal which became mixed and alloyed with the molten Al, while the oxygen thus abstracted from the $Co_2SiO_4$ became combined by oxidization with a certain portion of the molten Al metal to form extremely fine particles of $Al_2O_3$; and also some $SiO_2$ particles seem to have been formed. The pressure was maintained until the mass of molten Al metal was completely solidified, and then the resultant cast form was removed from the mold cavity by the use of a knock out pin, the part of this cast form which consisted only of Al metal was machined away, and from the part of said cast form in which the porous preform had been embedded was cut a cuboidal test piece of Co-Si-Al alloy in which fine particles of $Al_2O_3$ and of $SiO_2$ were dispersed.

Figure 14:
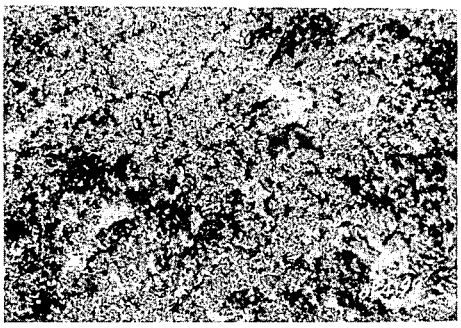
FIG. 14 is an optical photomicrograph of a section of a Co-Si-Al alloy with included $Al_2O_3$ particles and $SiO_2$ particles manufactured according to a seventh preferred embodiment of the present invention using the FIG. 1 apparatus, magnified 400X.

FIG. 14 is an optical photomicrograph of a section of the Co-Si-Al alloy manufactured as described above, magnified 400X times. In this this figure, the whitish portions are portions of the Co-Al alloy phase, while the grey portions are portions which have a structure of a mixture of $Al_2O_3$ particles and $SiO_2$ particles and Al. From this FIG. 14, it will be seen that, according to this seventh preferred embodiment of the present invention, it has been possible to manufacture a Co-Si-Al alloy (which had macro composition about 34.8% by weight of Co, about 8.3% by weight of Si, about 36.8% by weight of Al, and about 20.1% by weight of O, with the proportions of $SiO_2$ and of $Al_2O_3$ being about 27.2% by weight and about 10.5% by weight, respectively) with an even and fine structure, with the particles of $SiO_2$ and of $Al_2O_3$ finely dispersed in the alloy material.

Further, EPMA analysis and X-ray diffraction tests were carried out on the Co-Si-Al alloy manufactured as described above. The results of these tests are not particularly shown; however, it was confirmed that within the structure of the Co-Si-Al alloy manufactured as described above there were portions made of fine particles of $Al_2O_3$, formed by the oxidization of a part of the Al which was forced in molten form through the interstices of the porous $Co_2SiO_4$ preform by the reduction of the $Co_2SiO_4$ to produce oxygen, said fine particles of $Al_2O_3$ being dispered finely and evenly with the Co-Si-Al alloy mass; and furthermore there were particles of $SiO_2$ also formed by the aforesaid reduction of the $Co_2SiO_4$ material of the preform.

When this alloy was tested, it was confirmed that its strength, its heat resistance, and its anti wear characteristic were excellent.

Although no specific details about such matters will be given here in the interests of brevity of description, in fact, when a sequence of porous preforms were made in substantially the same way as described above but using as material (instead of $Co_2SiO_4$): $Fe_2O_3/TiO_2$, $ZnO/SiO_2$, $MnSiO_3$, $PbMoO_4$, $Na_3VO_4$, $NiFe_2O_4$ , $Na_2WO_4$, and when the same casting process as described above was performed in each case, again using pure Al as a molten metal for alloying, it was confirmed that substantially parallel results were obtained: in each case, in addition to alloy phase portions made out of the Al metal alloyed with the metal of the preform which had been reduced from the oxide of which it had been composed, there were fine $Al_2O_3$ particles as well as $SiO_2$ particles and the like (i.e. remnants of the compound oxide) dispersed in the alloy, said $Al_2O_3$ particles being made out of the Al alloy metal oxidized by the oxygen which has been reduced from the oxide of which the preform had been composed.

When each of these alloys was tested, again it was confirmed that its strength, its heat resistance, and its anti wear characteristic were excellent.

Thus, from this seventh preferred embodiment, it is understood that for the present invention it is not required for the oxide of the first metal and oxygen, that is to say the oxidizing agent for the oxidization and reduction reaction, to be a simple metal oxide; but it may be a composite oxide such as a silicate, a vanadate, a ferrate, a tungstenate or wolframite or the like.

THE EIGHTH PREFERRED EMBODIMENT

MOLTEN $B_2O_3$ COMPOUNDED INTO MIXED Al AND Fe POWDERS

Using a high pressure casting device of the same type as used in the case of the first preferred embodiment, i.e. of the FIG. 1 type, a Fi-Al-B alloy in which an oxide of Al, i.e. $Al_2O_3$, was finely dispersed, was made as follows.

First, a quantity of Fe powder material having a nominal composition of 99.4% Fe by weight and a nominal average particle diameter of 25 microns was mixed together with a quantity of Al powder of nominal purity 99.8% by weight and also having a nominal average particle diameter of 25 microns, the relative proportions of these powders being 7.9:5.4 by weight; and next the mixture powder was subjected to compression forming at a pressure of about 2100 kg/cm$^2$, so as to form porous preform, made substantially of Fe and Al and with a bulk density of about 2.7 gm/cc , with dimensions about 15 mm by 15 mm by 80 mm.

Next, a casting process was performed on the preform, similarly to the casting done in the case of the first preferred embodiment described above, by heating the preform up to a temperature of 300° C. in a vacuum, by then placing it into the mold cavity of the casting mold which itself was at a this time heated up to 200° C., and then by pouring a quantity of molten substance for providing a metal for serving as an alloy metal and for forming an oxide, in the case of this eighth preferred embodiment this molten substance not being a pure metal, but being substantially pure $B_2O_3$ of nominal purity 99.5% by weight and being heated to about 650° C., into the mold cavity over and around the preform. And next a pressure piston wsa forced into said mold cavity so as to pressurize the molten $B_2O_3$ mass to a pressure of about 1500 kg/cm$^2$ and thus to force it into the interstices between the Fe and Al particles making up the porous preform. Again, it is believed that at this time, as the molten $B_2O_3$ thus percolated through the porous preform, by the great affinity of Al for oxygen much of the material of the molten $B_2O_3$ was reduced to produce B metal which became mixed and alloyed with the Al and Fe metals, while the oxygen thus abstracted from the $B_2O_3$ became combined by oxidization with a certain portion of the Al metal to form extremely fine particles of $Al_2O_3$. The pressure was maintained until the mass of molten $B_2O_3$ was completely solidified, and then the resultant cast form was removed from the mold cavity by the use of a knock out pin, the part of this cast form which consisted only of $B_2O_3$ was machined away, and from the part of said cast form in which the porous preform had been embedded was cut a cuboidal test piece of Fe-Al-B alloy in which fine particles of $Al_2O_3$ were dispersed.

Figure 15:
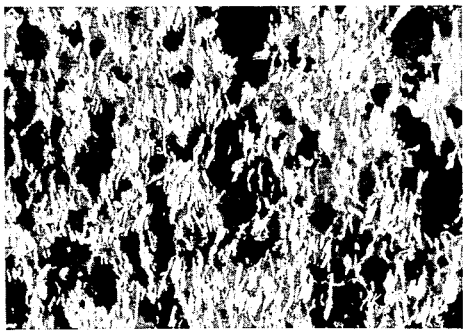
FIG. 15 is an optical photomicrograph of a section of a Fe-Al-B alloy with included $Al_2O_3$ particles manufactured according to a eighth preferred embodiment of the present invention using the FIG. 1 apparatus, magnified 100X.

FIG. 15 is an optical photomicrograph of a section of this Fe-Al-B alloy manufactured as described above, magnified 100X times. In this figure, the whitish portions of Fe, the grey portions are portions of the Fe-Al-B alloy phase, while the black portions are portions which have a structure of a mixture of $Al_2O_3$ and B. From this FIG. 15, it will be seen that, according to this eighth preferred embodiment of the present invention, it has been possible to manufacture a Fe-Al-B alloy (which had macro composition about 46.4% by weight of Fe, about 31.9% by weight of Al, about 6.8% by weight of B, and about 14.9% by weight of O, with the proportion of $Al_2O_3$ being about 31.8% by weight) with an even and fine structure, with the particles of $Al_2O_3$ finely dispersed in the alloy material.

Further, EPMA analysis and X-ray diffraction tests were carried out on the Fe-Al-B alloy manufactured as described above. The results of these tests are not particularly shown; however, it was confirmed that within the structure of the Fe-Al-B alloy manufactured as described above there were portions of an Fe-Al-B alloy phase, and further other portions made of fine particles of $Al_2O_3$, formed by the oxidization of a part of the Al powder in the preform by the reduction of the $B_2O_3$ to produce oxygen, said fine particles of $Al_2O_3$ being dispersed finely and evenly within the Fe-Al-B alloy phase.

When this alloy was tested, it was confirmed that its heat resistance and its anti wear characteristic were excellent.

Although no specific details about such matters will be given here in the interests of brevity of description, in fact, when a similar preform was made in substantially the same way as described above but using as mixture powder Ti powder instead of Fe powder, and when the same casting process as described above was performed in each case, again using $B_2O_3$ as a molten substance to be pressurized into the interstices of the preform, it was confirmed that substantially parallel results were obtained: in each case, in addition to alloy phase potions, there were fine $Al_2O_3$ particles dispersed in the alloy, made out of the Al metal oxidized by the oxygen which had been reduced from the $B_2O_3$. And when this alloy was tested, it was again confirmed that its heat resistance and its anti wear characteristic were excellent.

THE NINTH PREFERRED EMBODIMENT

MOLTEN $V_2O_5$ COMPOUNDED INTO MIXED Ti and Ni POWDERS

Using a high pressure casting device of the same type as used in the case of the eighth preferred embodiment described previously above, i.e. of the FIG. 1 type, a Ti-Ni-V alloy in which an oxide of Ti, i.e. $TiO_2$, was finely dispersed, was made as follows.

First, a quantity of Ni powder material having a nominal composition of 99.7% Ni by weight and a nominal average particle diameter of 25 microns was mixed together with a quantity of Ti powder of nominal purity 99% by weight and having a nominal average particle diamater of 10 microns, the relative proportions of these powders being 8.9:9.1 by weight; and next the mixture powder was subjected to compression forming at a pressure of about 1100 kg/cm$^2$, so as to form a porous preform, made substantially of Ni and Ti and with a bulk density of about 3.6 gm/cc .

Next, a casting process was performed on the preform, similarly to the casting done in the case of the eighth preferred embodiment described above, by heating the preform up to a temperature of 400° C. in a vacuum, by then placing it into the mold cavity of the casting mold, and then by pouring a quantity of molten substance for providing a metal for serving as an alloy metal and for forming an oxide, in the case of this ninth preferred embodiment this molten substance not being a pure metal, but being substantially pure $V_2O_5$ of nominal purity 99.5% by weight and being heated to about 850° C., into the mold cavity over and around the preform. And next a pressure piston was forced into said mold cavity so as to pressurize the molten $V_2O_5$ mass to a pressure of about 1000 kg/cm$^2$ and thus to force it into the interstices between the Ni and Ti particles making up the porous preform. Again, it is believed that at this time, as the molten $V_2O_5$ thus percolated through the porous preform, by the great affinity of Ti for oxygen much of the material of the molten $V_2O_5$ was reduced to produce V metal which became mixed and alloyed with the Ti and the Ni metals, while the oxygen thus abstracted from the $V_2O_5$ became combined by oxidization with a certain portion of the Ti metal to form extremely fine particles of $TiO_2$. The pressure was maintained until the mass of molten $V_2O_5$ was completely solidified, and then the resultant cast form was removed from the mold cavity by the use of a knock out pin, the part of this cast form which consisted only of $V_2O_5$ was machined away, and from the part of said cast form in which the porous preform had been embedded was cut a cuboidal test piece of Ti-Ni-V alloy in which fine particles of $TiO_2$ were dispersed.

Figure 16:
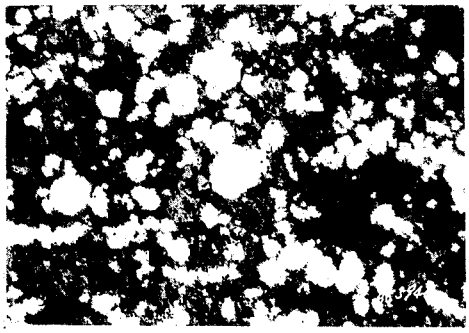
FIG. 16 is an optical photomicrograph of a section of a Ti-Ni-V alloy with included $TiO_2$ particles manufactured according to a ninth preferred embodiment of the present invention using the FIG. 1 apparatus, magnified 100X.

FIG. 16 is an optical photomicrograph of a section of this Ti-Ni-V alloy manufactured as described above, magnified 100X times. In this figure, the whitish portions are portions of Ni, while the grey portions and the black portions are portions of the Ti-Ni-V alloy phase which include $TiO_2$ particles. From this FIG. 16, it will be seen that, according to this ninth preferred embodiment of the present invention, it has been possible to manufacture Ti-Ni-V alloy (which had macro composition about 36.8% by weight of Ti, about 36.0% by weight of Ni, about 15.2% by weight of V, and about 12.0% by weight of O, with the proportion of $TiO_2$ being about 30.0% by weight) with an even and fine structure, with the particles of $TiO_2$ finely dispersed in the alloy material.

Further, EPMA analysis and X-ray diffraction tests were carried out on the Ti-Ni-V alloy manufactured as described above. The results of these tests are not particularly shown; however, it was confirmed that within the structure of the Ti-Ni-V alloy manufactured as described above there were portions of an Ti-Ni-V alloy phase, and further other portions made of fine particles of $TiO_2$, formed by the oxidization of a part of the Ti powder in the preform by the reduction of the $V_2O_5$ to produce oxygen, said fine particles of $TiO_2$ being dispersed finely and evenly.

When this alloy was tested, it was confirmed that its heat resistance and its anti wear characteristic were excellent.

Although no specific details about such matters will be given here in the interests of brevity of description, in fact, when a similar set of preforms were made in substantially the same way as described above but using as molten material to be forced into the interstices of the preforms, instead of $V_2O_5$ as above: PbO heated up to a temperature of 1200° C., $KBO_2$ heated up to a temperature of 1100° C., $NaBo_2$ heated up to a temperature of 1100° C., $Na_2WO_4$ heated up to a temperataure of 950° C., and $K_2SiO_3$ heated up to a temperature of 1100° C., and when the same casting process as described above was performed in each case, it was confirmed that substantially parallel results were obtained: in each case, in addition to alloy phase portions, there were fine $TiO_2$ particles dispersed in the alloy, made out of the Ti metal oxidized by the oxygen which had been reduced from the molten melt material. And when these alloys were tested, it was again confirmed that their heat resistance and its anti wear characteristic were excellent, and also that their sliding characteristics are very good.

THE TENTH PREFERRED EMBODIMENT

MOLTEN Zn-ZnO MIXTURE COMPOUNDED INTO Al POWDER

Using a die-cast casting device of the type used in the second preferred embodiment described above, i.e. of the FIG. 7 type, a Zn - Al alloy in which an oxide of Al, i.e. $Al_2O_3$, was finely dispersed, was made as follows.

First, a quantity of Al powder material having a nominal composition of 99.8% Al by weight and a nominal average particle diameter of 25 microns was subjected to compression forming at a pressure of about 200 kg/cm$^2$, so as to form a porous preform, made substantially of Al and with a bulk density of about 1.08 gm/cc , with dimensions about 15 mm by 15 mm by 80 mm.

Next, a casting process was performed on the preform, as described above and shown in FIG. 7, wherein said preform is designated by the reference numeral 13. After it had been heated up to 300° C. in a vacuum, the preform 13 was placed into the mold cavity 12 of the movable die 11 which itself was at this time heated up to 50° C., and then a quantity 17 of molten mixture for serving as an alloy metal and for forming an oxide, in the case of this tenth preferred embodiment being a molten mixture of about 90% by weight of Zn and about 10% by weight of ZnO, made by stirring ZnO powder of average particle diameter about 1.2 microns and nominal purity 99% by weight into molten Zn of nominal purity 99.3% by weight at a temperature of about 550° C. was poured through the hole 16 into the sleeve 9, so as to enter into the mold cavity 12 over and around the preform 13 to surround it. Then the plunger rod 14 and the plunger 15, which closely cooperated with the inner cylindrical surface of the casting sleeve 9, were forced into said mold cavity 12 and were forced inwards, so as to pressurize the molten Zn-ZnO mass 17 to a pressure of about 500 kg/cm$^2$ and thus to force it into the interstices between the Al particles making up the porous preform 13. It is believed that at this time, as the molten Zn-ZnO mass thus percolated through the porous preform 13, by the great affinity of aluminum for oxygen much of the ZnO was reduced to produce Zn metal which became mixed with the remainder of the molten Zn, while the oxygen thus abstracted from the ZnO became combined by oxidization with a certain portion of the aluminum metal to form extremely fine particles of $Al_2O_3$. The pressure of about 500 kg/cm$^2$ was maintained until the mass 17 of molten Zn-ZnO mixture was completely solidified, and then the resulting cast form was removed from the mold cavity 12 by separating the fixed die 10 and the movable die 11, and by the use of a knock out pin not shown in the drawing. Finally, the part of this cast form which consisted only of Zn-ZnO mixture material was machined away, and from the part of said cast form in which the porous preform 13 had been embedded was cut a cuboidal test piece of Zn-Al alloy material in which fine particles of $Al_2O_3$ were dispersed.

Figure 17:
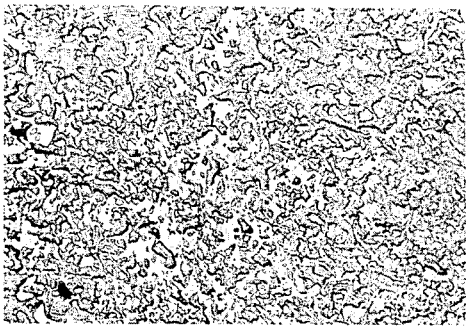
FIG. 17 is an optical photomicrograph of a section of a Zn-Al alloy with included $Al_2O_3$ particles manufactured according to a tenth preferred embodiment of the present invention using the FIG. 7 apparatus, magnified 400X.

FIG. 17 is an optical photomicrograph of a secton of this Zn-Al alloy manufactured as described above, magnified 400X times. In this figure, the whitish island portions are portions of the Zn-Al alloy phase, while the background bright grey portions are portions which have a structure of a mixture of $Al_2O_3$ and Zn. From this FIG. 17, it will be seen that, according to this tenth preferred embodiment of the present invention, it has been possible to manufacture a Zn-Al alloy (which had macro composition about 73.1% by weight of Zn, about 20.5% by weight of Al, and about 6.4% by weight of O, with the proportion of $Al_2O_3$ being about 13.6% by weight) with an even and fine structure, with the particles of $Al_2O_3$ finely dispersed in the alloy material.

Further, EPMA analysis and X-ray diffraction tests were carried out on the Zn-Al alloy manufactured as described above. The results of these analyses are not particularly shown; however, it was confirmed that the ZnO had been reduced by the Al, and that within the structure of the Zn-Al alloy manufactured as described above there were portions of the Zn-Al alloy phase and other portions made of fine particles of $Al_2O_3$, formed by the oxidization of a portion of the Al by the oxygen abstracted for the ZnO portion of the melt which was forced in molten form through the interstices of the porous Al preform by the reduction of that ZnO to produce oxygen, said fine particles of $Al_2O_3$ being dispersed finely and evenly within the Zn-Al alloy mass.

When this alloy was tested, it was confirmed that its wear resistance characteristic and its sliding characteristic were excellent.

Although no specific details about such matters will be given here in the interests of brevity of description, in fact, when a sequence of porous preforms were made in substantially the same way as described above but using as material (instead of Al powder) Ti powder and Mg powder, and when the same casting process as described above was performed in each case, again using molten material containing about 90% by weight of Zn and about 10% by weight of ZnO as a material for alloying, it was confirmed that substantially parallel results were obtained; in each case, in addition to alloy phase portions made out of the Zn alloyed with the powder metal of the preform, there were fine oxide particles dispersed in the alloy, made out of the powder metal of the preform oxidized by the oxygen which had been reduced from the ZnO in the melt material.

When each of these alloys was tested, again it was confirmed that its wear resistance characteristic and its sliding characteristic were excellent.

From the above series of the eighth, the ninth, and the tenth preferred embodiments, it can be seen that, also in the cases that a metal with a strong tendency to form an oxide is present in the form of a finely powdered solid in the porous solid material, and the melt is a molten metal oxide, or alternatively such a molten metal oxide is present in the melt along with some other material, then between these an oxidization reduction reaction occurs, and the alloying process proceeds particularly well because of the heat produced in this reaction, and an alloy can be obtained in which the oxide of that metal with a strong tendency to form oxide is finely and evenly dispersed.

THE ELEVENTH PREFERRED EMBODIMENT

MOLTEN Sn METAL COMPOUNDED INTO MIXED $V_2O_5$ AND Al POWDERS

Using a high pressure casting device of the same type used in the cse of the first preferred embodiment, i.e. of the FIG. 1 type, Al-V-Sn alloy in which an oxide of Al, i.e. $Al_2O_3$, was finely dispersed, was made as follows.

First, a quantity of $V_2O_5$ powder material having a nominal purity of 98% by weight and a nominal average particle diameter of 10 microns was mixed together with a quantity of Al powder of nominal purity 99.8% by weight and having a nominal average particle diameter of 25 microns, the relative proportions of these powders being 1:2 by weight; and next the mixture powder was subjected to compression forming at a pressure of about 500 kg/cm$^2$, so as to form a porous preform, made substantially of $V_2O_5$ and Al and with a bulk density of about 1.46 gm/cc , with dimensions about 15 mm by 15 mm by 80 mm.

Next, a casting process was performed on the preform, similarly to the casting done in the case of the first preferred embodiment described above, after heating the preform up to a temperature of 200° C. in a vacuum, by then placing it into the mold cavity of the casting mold which itself was at this time heated up to 50° C., and then by pouring a quantity of molten metal for serving as an alloy metal for forming an oxide, in the case of this eleventh preferred embodiment this molten metal being substantially pure Sn of nominal purity 99% by weight and being heated to about 350° C., into the mold cavity over and around the preform. And next a pressure piston was forced into said mold cavity so as to pressurize the molten Sn metal mass to a pressure of about 500 kg/cm$^2$ and thus to force it into the interstices between the $V_2O_5$ and Al particles making up the porous preform. Again, it is believed that at this time, as the molten Sn metal thus percolated through the porous preform, by the great affinity of Al for oxygen much of the material of the $V_2O_5$ particles was reduced to produce V metal which became mixed and alloyed with the molten Sn metal, along with some of the Al metal of the Al particles, while the oxygen thus abstracted from the $V_2O_5$ particles became combined by oxidization with a certain portion of the molten Al metal to form extremely fine particles of $Al_2O_3$. The pressure was maintained until the mass of molten Sn metal was completely solidified, and then the resultant cast form was removed from the mold cavity by the use of a knock out pin, the part of this cast form which consisted only of Sn metal was machined away, and from the part of said cast form in which the porous preform had been embedded was cut a cuboidal test piece of Al-V-Sn alloy in which fine particles of $Al_2O_3$ were dispersed.

Figure 18:
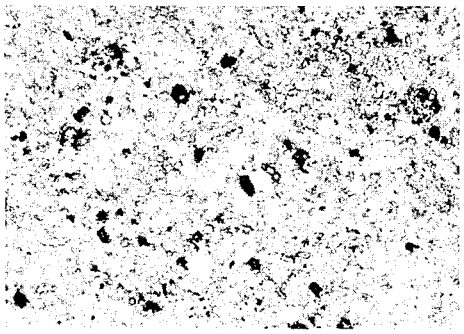
FIG. 18 is an optical photomicrograph of a section of a Al-V-Sn alloy with included $Al_2O_3$ particles manufactured according to a eleventh preferred embodiment of the present invention using the FIG. 1 apparatus, magnified 400X.

FIG. 18 is an optical photomicrograph of a section of this Al-V-Sn alloy manufactured as described above, magnified 400X times. In this figure, the particulate grey portions are portions made up of the Al-V alloy phase, the black particulate portions are portions with a structure of a mixture of the Al-V alloy and $Al_2O_3$, while the background grey portions are portions which have a structure of a mixture of $Al_2O_3$ and Sn. From this FIG. 18, it will be seen that, according to this eleventh preferred embodiment of the present invention, it has been possible to manufacture a Al-V-Sn alloy (which had macro composition about 17.6% by weight of Al, about 6.2% by weight of V, about 71.4% by weight of Sn, and about 4.8% by weight of O, with the proportion of $Al_2O_3$ being abou 10.2% by weight) with an even and fine structure, with the particles of $Al_2O_3$ finely dispered in the alloy material.

Further, EPMA analysis and X-ray diffraction tests were carried out on the Al-V-Sn alloy manufactured as described above. The results of these tests are not particularly shown; however, it was confirmed that within the structure of the Al-V-Sn alloy manufactured as described above there were portions of the Al-V-Sn alloy phase, and further other portions made of fine particles of $Al_2O_3$, formed by the oxidization of a part of the Al which was mixed in powder form with the $V_2O_5$ powder to make up the preform, the oxygen having come from the reduction of the $V_2O_5$ powder, said fine particles of $Al_2O_3$ being dispersed finely and evenly within the Sn.

When this alloy was tested, it was confirmed that its strength, its heat resistance, and its anti wear characteristic were excellent.

Although no specific details about such matters will be given here in the interests of brevity of description, in fact, when a sequence of porous preforms were made in substantially the same way as described above but using as material to be mixed with the Al powder (instead of $V_2O_5$ powder): $WO_3$, $Fe_2O_3$, $MnO_2$, CoO, $Nb_2O_5$, $Ta_2O_5$, $TiO_2$, $Cr_2O_3$, and NiO, and when the same casting process as described above was performed in each case, again using pure Sn as a molten metal for alloying, it was confirmed that substantially parallel results were obtained; in each case, in addition to alloy phase portions made out of the Sn metal and the Al metal alloyed with the metal of the above specified powder material in the preform which had been reduced from the oxide of which said preform had been composed, there were fine $Al_2O_3$ particles dispersed in the alloy, made out of the Al powder metal in the preform oxidized by the oxygen which had been reduced from the metallic oxide of which the preform had been composed. And it was in each case verified that these $Al_2O_3$ particles were well and evenly dispersed in the metal alloy.

When each of these alloys was tested, again it was confirmed that its strength, its heat resistance, and its anti wear characteristic were excellent.

THE TWELFTH PREFERRED EMBODIMENT

MOLTEN Zn COMPOUNDED INTO MIXED Al POWDER AND $MnSiO_3$ POWDER

Again using a die-cast casting device of the type used in the second preferred embodiment described above, i.e. of the FIG. 7 type, a Mn-Al-Zn alloy in which an oxide of Al, i.e. $Al_2O_3$, was finely dispersed, was made as follows.

First, a quantity of Al powder material having a nominal composition of 99.8% Al by weight and a nominal average particle diameter of 25 microns was mixed with a quantity of $MnSiO_3$ powder having nominal purity of 99.2% by weight and a nominal average particle diameter of 5 microns, and the mixture was well mixed together and then was subjected to compression forming at a pressure of about 500 kg/cm$^2$, so as to form a porous preform, made substantially of Al and $MnSiO_3$ and with a bulk density of about 1.55 gm/cc , with dimensions about 15 mm by 15 mm by 80 mm.

Next, a casting process was performed on the preform, as described above and shown in FIG. 7. After it had been heated up to 300° C. in a vacuum, the preform 13 was placed into the mold cavity 12 of the movable die 11 which itself was at this time heated up to 200° C., and then a quantity 17 of molten metal for serving as an alloy metal and for forming an oxide, in the case of this twelfth preferred embodiment being molten Zn of nominal purity 99.3% by weight of a temperature of about 550° C., was poured through the hole 16 into the sleeve 9, so as to enter into the mold cavity 12 over and around the preform 13 to surround it. Then the plunger rod 14 and the plunger 15 were forced into said mold cavity 12 and were forced inwards, so as to pressurize the molten Zn mass 17 to a pressure of about 500 kg/cm$^2$ and thus to force it into the interstices between the Al particles and the $MnSiO_3$ particles making up the porous preform 13. It is believed that at this time, as the molten Zn mass thus percolated through the porous preform 13, by the great affinity of aluminum for oxygen much of the $MnSiO_3$ was reduced to produce Mn metal which became mixed with the remainder of the molten Zn, while the oxygen thus abstracted from the $MnSiO_3$ became combined by oxidization with a certain portion of the aluminum metal to form extremely fine particles of $Al_2O_3$; and some $SiO_2$ particles were also formed. The pressure of about 500 kg/cm$^2$ was maintained until the mass 17 of molten Zn was completely solidified, and then the resultant cast form was removed from the mold cavity 12 by separating the fixed die 10 and the movable die 11, and by the use of a knock out pin, not shown. Finally, the part of this cast form which consisted only of Zn was machined way, and from the part of said cast form in which the porous preform 13 had been embedded was cut a cuboidal test piece of Mn-Al-Zn alloy material in which fine particles of $Al_2O_3$ and of $SiO_2$ were dispersed.

Figure 19:
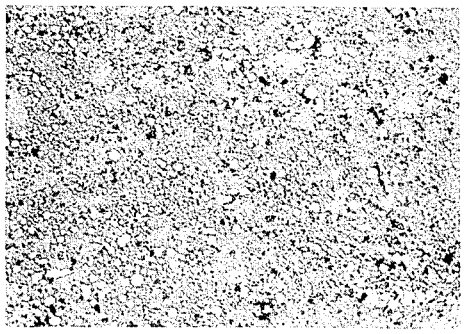
FIG. 19 is an optical photomicrograph of a section of a Mn-Al-Zn alloy with included $Al_2O_3$ and $SiO_2$ particles manufactured according to a twelfth preferred embodiment of the present invention using the FIG. 7 apparatus, magnified 400X.

FIG. 19 is an optical photomicrograph of a section of this Mn-Al-Zn alloy manufactured as described above, magnified 400X times. In this figure, the granular whitish portions are portions of the Mn-Al alloy phase, while the background grey and black portions are portions which have a structure of a mixture of $Al_2O_3$ and $SiO_2$ particles with Zn-Al alloy. From this FIG. 19, it will be seen that, according to this twelfth preferred embodiment of the present invention, it has been possible to manufacture a Mn-Al-Zn alloy (which had macro composition about 7.2% by weight of Mn, about 13.2% by weight of Al, 3.7% by weight of Si, 69.7% by weight of Zn, and about 6.3% by weight of O, with the proportion of $Al_2O_3$ being about 4.5% by weight and the proportion of $SiO_2$ being about 7.8% by weight) with an even and fine structure, with the particles of $Al_2O_3$ and of $SiO_2$ being finely and evenly dispersed in the alloy material.

Further, EPMA analysis and X-ray diffraction tests were carried out on the Mn-Al-Zn alloy manufactured as described above. The results of these analyses are not particularly shown; however, it was confirmed that the $MnSiO_3$ had been reduced by the Al, and that within the structure of the Mn-Al-Zn alloy manufactured as described above there were portions of the Mn-Al alloy phase and also portions of a Zn-Al alloy phase, with other portions made of fine particles of $Al_2O_3$ and of $SiO_2$, formed by the oxidization of a portion of the Al by the oxygen abstracted from the $MnSiO_3$ portion of the preform as the Zn was forced in molten form through the interstices of the porous Al and $MnSiO_3$ preform by the reduction of that $MnSiO_3$ to produce oxygen, said fine particles of $Al_2O_3$ and of $SiO_2$ being dispersed finely and evenly within the Zn-Al alloy mass.

Although no specific details about such matters will be given here in the interests of brevity of description, in fact, when a sequence of porous preforms were made in substantially the same way as described above but using as material (instead of $MnSiO_3$ powder): $Fe_2O_3$ powder, $TiO_2$ powder, $PbMoO_4$ powder, $Na_3VO_4$ powder, $NiFe_2O_4$ powder, and $Na_2WO_4$ powder, and when the same casting process as described above was performed in each case, again using molten Zn as a material for alloying, it was confirmed that substantially parallel results were obtained: in each case, in addition to alloy phase portions made out of the Zn alloyed with the powder metal of the preform, there were fine oxide particles dispersed in the alloy, made out of the powder metal of the preform oxidized by the oxygen which had been reduced from the oxide in the preform material.

THE THIRTEENTH PREFERRED EMBODIMENT

MOLTEN Zn METAL COMPOUNDED INTO MIXED Ti AND $WO_3$ POWDERS

Using a horizontal centrifugal type casting device of the type used in the third preferred embodiment described above, i.e. of the FIG. 9 type, a W-Ti-Zn alloy in which an oxide of Ti, i.e. $TiO_2$, was finely dispersed, was made as follows.

First, a quantity of Ti powder material having a nominal purity of 97.6% by weight and a nominal average particle diameter of 10 microns was mixed thoroughly with a quantity of $WO_3$ powder of nominal purity of 99.9% by weight having a nominal average particle diameter of 3 microns, and the mixture powder then was subjected to compression forming at a pressure of about 1200 kg/cm$^2$, so as to form a porous preform, made substantially of Ti and $WO_3$ and with a bulk density of about 5.85 gm/cc, with dimensions about 15 mm by 15 mm by 80 mm.

Next, a casting process was performed on the preform, as schematically shown in section in FIG. 9 wherein said preform is designated by the reference numeral 26. After the preform 26 had been heated up to 400° C. in a vacuum, it was placed into the mold cavity of the mold 22 (which had an inner diameter of 100 mm) which itself was at this time heated up to 100° C., and then a quantity 28 of molten metal for serving as an alloy metal and for forming an oxide, in the case of this thirteenth preferred embodiment being molten zinc of nominal purity 99.3% by weight and being heated to about 550° C., was poured into the mold cavity of the mold 22 over and around the preform 26. Then the casting drum 19 and the mold 22 were rotated by the rollers 23 and 24 at a rotational speed of about 200 rpm, so as to pressurize the molten Zn metal mass 28 and thus to force it into the interstices between the Ti and $WO_3$ particles making up the porous preform 26. It is believed that at this time, as the molten Zn metal mass thus percolated through the porous preform 26, by the great affinity of Ti for oxygen much of the $WO_3$ was reduced to produce W metal which became mixed and alloyed with the molten Zn metal and some of the Ti metal to form an alloy, while the oxygen thus abstracted from the $WO_3$ became combined by oxidization with a certain portion of the Ti metal particles to form extremely fine particles of $TiO_2$. The spinning of the casting drum 19 and the mold 22 was maintained until the mass 28 of molten Zn metal was completely solidified, and then the resultant cast form was removed from the mold cavity of the mold 22 by separating the mold 22 and the casting drum 19. Finally, the part of this cast form which consisted only of Zn metal was machined away, and from the part of said cast form in which the porous preform 26 had been embedded was cut a cuboidal test piece of W-Ti-Zn alloy in which fine particles of $TiO_2$ were dispersed.

Figure 20:
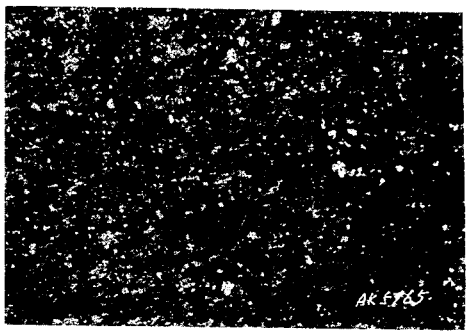
FIG. 20 is an optical photomicrograph of a section of a W-Ti-Zn alloy with included $TiO_2$ particles manufactured according to a thirteenth preferred embodiment of the present invention using the FIG. 9 apparatus, magnified 400X.

FIG. 20 is an optical photomicrograph of a section of this W-Ti-Zn alloy manufactured as described above, magnified 400X times. In this figure, the granular whitish portions are portions of the W-Ti alloy phase, and the black portions are portions of $TiO_2$, while the grey background portions are portions which have a structure of a mixture of $TiO_2$ and Zn metal. From this FIG. 20, it will be seen that, according to this thirteenth preferred embodiment of the present invention, it has been possible to manufacture a W-Ti-Zn alloy (which had macro composition about 22% by weight of W, about 17.5% by weight of Ti, about 54.8% by weight of Zn, and about 5.7% by weight of O, with the proportion of $TiO_2$ being about 14.1% by weight) with an even and fine structure, with the particles of $TiO_2$ finely dispersed in the alloy material.

Further, EPMA analysis and X-ray diffraction tests were carried out on the W-Ti-Zn alloy manufactured as described above. The results of these analyses are not particularly shown; however, it was confirmed that the $WO_3$ had been reduced by the Zn, and that within the structure of the W-Ti-Zn alloy manufactured as described above there were portions of the W-Ti-Zn alloy phase and other portions made of fine particles of $TiO_2$, formed by the oxidization of a portion of the Ti in the preform by oxygen reduced from the $WO_3$ in said preform as the Zn was forced in molten form through the interstices of the porous preform, said fine particles of $TiO_2$ being dispersed finely and evenly within the W-Ti-Zn alloy mass.

When this alloy was tested, it was confirmed that its heat resistance and its frictional characteristics were excellent.

Although no specific details about such matters will be given here in the interests of brevity of description, in fact, when a series of porous preforms were made in substantially the same way as described above but using as powder material to be added to the Ti powder to form the preform, instead of $WO_3$ powder: $MoO_3$ powder, $MnO_2$ powder, CoO powder, $Fe_2O_3$ powder, and $Cr_2O_3$ powder, and when the same casting process as described above was performed in each case, again using molten Zn metal as a melt metal for alloying, it was confirmed that substantially parallel results were obtained: in each case, in addition to alloy phase portions made out of the Zn metal further alloyed with the Ti metal of the preform and with the metal which had been reduced from the oxide of which said preform had been composed, there were fine $TiO_2$ particles dispersed in the alloy, made out of some of the Ti powder oxidized by the oxygen which had been reduced from the oxide material of which the preform had been composed.

When each of these alloys was tested, again it was confirmed that its characteristics were excellent.

From the above series of the eleventh, the twelfth, and the thirteenth preferred embodiments, it can be seen that, also in the cases that into a porous solid formed from a metal oxide or a composite metal oxide and a metal whose tendency to form an oxide is stronger than that of the metal of the metal oxide or composite metal oxide, is caused to permeate another molten metal, then an oxidization reduction reaction between the metal oxide or composite metal oxide and the metal with a strong tendency to form an oxide occurs, because of the heat transmitted by the molten metal, and the alloying proceeds well because of the heat generated by this reaction, and fine particles of oxide of the metal with a strong tendency to form an oxide are dispersed evenly through the structure of the resulting alloy material. It will also be understood that in this case, provided that the temperature of the molten metal which is permeated into the preform is high enough, in fact any molten metal will be satisfactory for the purpose.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A method for making an alloy of a first metal and a second metal having a fine distribution of an oxide of said second metal in a matrix of said alloy, said second metal having a stronger tendency to form an oxide than said first metal, comprising:

(a) preparing a powder comprising an oxide of said first metal;

(b) forming a porous preform having interstices from said powder;

(c) placing said porous preform in a bath of molten metal comprising said second metal;

(d) pressurizing said bath of molten metal so as to infiltrate said molten metal into the interstices of said porous preform;

(e) reducing said oxide of said first metal by said second metal while forming thereby an oxide of said second metal; and wherein the second metal in a mass of said molten metal infiltrated into the interstices of said porous preform has a greater tendency to form an oxide than the first metal of said first metal oxide in said porous preform so that said porous preform and said mass of molten metal infiltrated into the interstices of said porous preform form said alloy, with said first metal thus reduced being alloyed with a first part of said second metal in said mass of molten metal while a second part of the second metal in said mass molten metal forms said oxide thereof, which oxide is finely distributed in the matrix of said alloy thus formed.

2. A method for making an alloy according to claim 1, wherein said compound of said first metal with oxygen is an oxide.

3. A method for making an alloy according to claim 1, wherein said compound of said first metal with oxygen is a simple oxide.

4. A method for making an alloy according to claim 1, wherein said compound of said first metal with oxygen is a compound oxide.

5. A method for making an alloy according to claim 1, wherein said powdered solid comprises said compound of said first metal with oxygen, and said melt contains said second metal.

6. A method for making an alloy according to claim 1, wherein said powdered solid comprises said second metal, and said melt comprises said compound of said first metal with oxygen.

7. A method for making an alloy according to claim 1, wherein said powdered solid comprises both said compound of said first metal with oxygen and said second metal.

8. A method for making an alloy according to claim 1, wherein a porous solid including said powdered solid is formed, and the melt is caused to permeate said porous solid.

9. A method for making an alloy according to claim 1, wherein a porous solid including a mixture of a powdered solid formed of said compound of said first metal with oxygen and a powdered solid formed of said second metal is formed, and the melt, which comprises a third metal, is caused to permeate said porous solid.

10. The method of making an alloy according to claim 1, wherein said alloy is a Mo-Al alloy having $Al_2O_3$ dispersed therein.

11. The method of making an alloy according to claim 1, wherein said alloy is a Co-Zn-Al alloy having $Al_2O_3$ dispersed therein.

12. The method of making an alloy according to claim 1, wherein said alloy is a Mn-Zn alloy having ZnO dispersed therein.

13. The method of making an alloy according to claim 1, wherein said alloy is a Mn-Mg alloy having MgO dispersed therein.

14. The method of making an alloy according to claim 1, wherein said alloy is a Ti-Mg alloy having MgO dispersed therein.

15. The method of making an alloy according to claim 1, wherein said alloy is a Ni-Fe-Al alloy having $Al_2O_3$ dispersed therein.

16. The method of making an alloy according to claim 1, wherein said alloy is a Co-Si-Al alloy having $Al_2O_3$ and $SiO_2$ dispersed therein.

17. The method of making an alloy according to claim 1, wherein said alloy is a Fe-Al-B alloy having $Al_2O_3$ dispersed therein.

18. The method of making an alloy according to claim 1, wherein said alloy is a Ti-Ni-V alloy having $TiO_2$ dispersed therein.

19. The method of making an alloy according to claim 1, wherein said alloy is a Zn-Al alloy having $Al_2O_3$ dispersed therein.

20. The method of making an alloy according to claim 1, wherein said alloy is a Al-V-Sn alloy having $Al_2O_3$ dispersed therein.

21. The method of making an alloy according to claim 1, wherein said alloy is a Mn-Al-Zn alloy having $Al_2O_3$ dispersed therein.

* * * * *